US006021205A

United States Patent [19]

Yamada et al.

[11] Patent Number: 6,021,205

[45] Date of Patent: *Feb. 1, 2000

[54] HEADPHONE DEVICE

[75] Inventors: Yuji Yamada, Tokyo; Kiyofumi Inanaga, Kanagawa, both of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/700,173

[22] Filed: Aug. 20, 1996

[30] Foreign Application Priority Data

Aug. 31, 1995 [JP] Japan ..... 7-224004

[51] Int. Cl.[7] ..... H04R 5/00

[52] U.S. Cl. ..... 381/310; 381/74

[58] Field of Search ..... 381/17, 18, 1, 381/25, 74, 61, 63, 309, 310, 311

[56] References Cited

U.S. PATENT DOCUMENTS

| | | | |
|---|---|---|---|
| 4,188,504 | 2/1980 | Kasuga et al. | 381/17 |
| 4,817,149 | 3/1989 | Myers | 381/1 |
| 5,173,944 | 12/1992 | Begault | 381/17 |
| 5,181,248 | 1/1993 | Inanaga et al. | 381/74 |
| 5,381,482 | 1/1995 | Matsumoto et al. | 381/18 |
| 5,386,082 | 1/1995 | Higashi | 381/17 |
| 5,438,623 | 8/1995 | Begault | 381/25 |
| 5,440,639 | 8/1995 | Suzuki et al. | 381/17 |
| 5,495,534 | 2/1996 | Inanaga et al. | 381/74 |
| 5,500,900 | 3/1996 | Chen et al. | 381/17 |

*Primary Examiner*—Ping Lee
*Attorney, Agent, or Firm*—Jay H. Maioli

[57] ABSTRACT

A headphone device having the function of detecting the head turning angle, in which attempts to realize sound image localization in the forward direction and that in the rear direction simultaneously does not result in the impulse response processing becoming voluminous. If a headphone 7 experiences a rotary movement, a rotational angular velocity sensor 8, mounted on a headband 7*a*, outputs a voltage proportionate to the angular velocity. The output voltage is filtered by a bandwidth limiting filter 9 and encoded by an A/D converter 10 to enter a micro-processor 11. The output signal of the A/D converter 10, entering the micro-processor 11, is sampled at a pre-set time interval and integrated so as to be converted into angular data. A rotational angle for actually localizing the sound image is calculated from the angular data and corresponding signal processing data is transmitted to a digital signal processing circuit 4.

14 Claims, 16 Drawing Sheets

HEADPHONE DEVICE

FIELD OF THE INVENTION

This invention relates to a headphone device having the function of detecting the head turning angle.

BACKGROUND OF THE INVENTION

In general, the speech signals accompanying a picture, such as a motion picture, are recorded on the assumption that they are reproduced by speakers arranged on both sides of the picture. This leads to coincidence between the sound source in the picture and the actually heard sound image position, thus establishing a spontaneous localized position relation between the picture and the speech.

However, if such speech is to be appreciated using a conventional headphone device, the sound image is localized in the listener's head and the sound image position localization becomes extremely non-spontaneous, with the picture direction being non-coincident with the position of sound image localization. The same may be said of the case of appreciation of only the speech, such as music sound, since the sound being heard as if it were emanated from the listener's head represents an extremely non-spontaneous phenomenon in distinction from the case of speaker reproduction.

For obviating this inconvenience, there is known a method in which, for producing a sound field equivalent to that produced in the case of speaker reproduction, the impulse response from a speaker placed in front of the listener's both ears is measured or calculated and convolved in the speech signal by a digital filter such as FIR filter so as to be heard through a headphone device. Although the sound image is localized outside the listener's head, the forward side sound image is still localized within or laterally to the listener's head, so that the problem of non-spontaneity is not obviated. If the sound accompanies a picture, the sound image is moved in synchronism with the head movement, thus producing deviation between the image direction and the sound direction and hence an extremely non-spontaneous sound image localization.

There is also known a method in which the head movement of the listener is detected and the digital filter coefficients are accordingly updated from time to time for localizing the direction of the sound image at all times with respect to the hearing environment. The digital signal processor has a digital filter, such as an FIR filter. With this method, the sound image is not localized within the user's head and the sound image strongly resembling the sound image reproduced by the speaker placed on the front side is realized. However, it becomes necessary in this case to update the coefficients each time the user's head makes a minute movement, thus requiring an extremely large number of sum-of-product processors and memories.

There is also known a method for avoiding complexities in sequentially updating the coefficients, according to which the digital filter coefficients are fixed at data of the head transfer function in a pre-set direction and corrections for head movement are made for all input signals by a time difference load device and a level difference addition device. This method eliminates the necessity of sequentially correcting the coefficients and enables the circuit scale to be reduced significantly. However, the direction of sound image localization that may be realized with the time difference load device and the level difference addition device is limited to an angular range of forward 180°, while the sound image cannot be localized behind the head.

However, if an attempt to calculate the turning angle of the head using a rotary angle sensor as described above, and the headphone device is used with this angle, the processing volume of the updated impulse response becomes voluminous and the system becomes costly in such a case wherein the multi-channel speech signal is reproduced as a forward or backward localized sound image. If the above arrangement is implemented by a simplified system, the direction of sound image localization is limited to a forward angular range of 180°, while it is impossible to realize rear sound image localization simultaneously.

SUMMARY OF THE INVENTION

One object of the present invention is to provide a headphone device wherein the sound image may be localized simultaneously in the forward and backward directions while the impulse response processing volume is maintained at a smaller value.

According to a first embodiment of the present invention, a headphone device includes 2N digital filter means for convolving an impulse response converted into the time domain from a head transfer function reaching both ears of the user from N sound sources placed at such positions as to localize N-channel speech input signals in a pre-set direction outside the head of the headphone user, a first pair of addition means for summing outputs with the same signs of L and R of 2M digital filter means associated with M channels among the above N channels, where $M \leqq N$, a second pair of addition means for summing outputs with the same signs of L and R of 2 (N-M) digital filter means associated with (N-M) channels among the N channels, a first pair of time difference addition means or a first pair of phase difference addition means connected to L and R side outputs of the first pair of addition means, a second pair of time difference addition means or phase difference addition means connected to L and R side outputs of the second pair of addition means, and a third pair of addition means for summing the same sign outputs of L and R channels of the first pair of time difference addition means or the first pair of phase difference addition means or the same sign outputs of L and R channels of the second pair of time difference addition means or the second pair of phase difference addition means. The increasing/decreasing direction of the time difference added by the first pair of time difference addition means or the first pair of phase difference addition means and the second pair of time difference addition means or the second pair of phase difference addition means is reversed depending on the angle of rotational movement detected by an angle of rotational movement calculation means for updating signal processing contents in a signal processing means for localizing a sound image in a pre-set direction outside the head of the headphone user.

The delay time difference or the phase difference between two ears equivalent to those when the sound of an actual sound source is heard as the listener moves his or her head may be realized both for the forward speech signals and for the rear speech signals, so that optimum outside-head sound image localization can be achieved in all directions.

The signal processing means has, on an input side or on an output side of the first pair of time difference addition means or the first pair of phase difference addition means, a first pair of level difference addition means, while having, on an input side or on an output side of the second pair of time difference addition means or the second pair of phase difference addition means, a second pair of level difference addition means. The direction of increasing or decreasing the level differences added by the first level difference addition means and by the second level difference addition means is reversed depending on the angle of rotational movement detected by the angle of rotational movement calculation means, whereby the level difference characteristics between two ears equivalent to those if the user hears the sound from an actual sound source as he or she turned his or her head may be realized both for the forward speech signals and for the rear speech signals.

The signal processing means also has, on an input side or on an output side of the first pair of time difference addition means or the first pair of phase difference addition means, a first pair of frequency characteristics controlling means, while having, on an input side or on an output side of the second pair of time difference addition means or the second pair of phase difference addition means, a second pair of frequency characteristics controlling means. The direction of changing the frequency characteristics, controlled by the first pair of the frequency characteristics controlling means and the second pair of the frequency characteristics controlling means, is reversed depending on the angle of rotational movement detected by the angle of rotational movement calculation means, whereby the changes in frequency characteristics between two ears equivalent to those if the user hears the sound from an actual sound source as he or she turns his or her head may be realized both for the forward speech signals and for the rear speech signals.

Specifically, the input speech channels are divided into channels the sound image of which is to be localized at a position 180° ahead of the listener and into channels the sound image of which is to be localized at a position 180° at back of the listener, and fixed impulse response data are convolved for these two channels. Time difference addition means and level difference addition means, whose characteristics are changed in the reverse directions for the forward rotation and the rearward rotation of the head of the user, are provided for forward and rear sides.

The headphone device according to the present invention includes, as signal processing means, 2N digital filter means for convolving an impulse response converted into the time domain from a head transfer function reaching both ears of the user from N sound sources placed at such positions as to localize N-channel speech input signals in a pre-set direction outside the head of the headphone user. The headphone device also includes a pair of addition means for summing the same signs of L and R of respective digital filters of respective channels in each of a plurality of blocks divided from the N channels of the speech signals depending on the direction of localization for the state of the headphone user facing the front side as a reference state, a pair of time difference addition means or a pair of phase difference addition means connected to L and R side outputs of the first pair of the addition means, and addition means for summing the same signs of L and R side outputs of the pair of the time difference addition means or the pair of the phase difference addition means. The amount of the time difference or the phase difference added by the pair of the time difference addition means or the pair of the phase difference addition means is independently changed from block to block depending on the angle of rotational movement detected by the angle of rotational movement calculation means for updating signal processing contents in the signal processing means. In this manner, difference characteristics between the two ears approximate to those when the user hears the speech signals in all directions as he or she turns his or her head, and optimum outside-head sound image localization may be realized in all directions.

The signal processing means has a pair of level difference addition means on an input side or on an output side of the pair of time difference addition means or the pair of phase difference addition means and causes the level difference added by the pair of the level difference addition means to be independently changed depending on the angle of rotational movement detected by the angle of rotary movement calculation means.

The signal processing means has a pair of frequency characteristics controlling means on an input side or on an output side of the pair of time difference addition means or the pair of phase difference addition means and causes the frequency characteristics controlled by the pair of frequency characteristics controlling means to be independently changed depending on the angle of rotational movement detected by the angle of rotary movement calculation means.

The headphone device according to the present invention includes signal processing means which divides part of the channels of the N channels of speech input signals into plural routes, adds the level difference or the phase difference to the routes depending on the position of localization of a sound image for summing to remaining plural channels for decreasing the number of channels to M (M<N) and subsequently performs digital processing on the respective channels. Thus it becomes unnecessary to perform digital signal processing for all channels and an optimum outside-head sound image localization of multi-channel speech signals may be realized with a smaller amount of signal processing.

DESCRIPTION OF THE PREFERRED EMBODIMENTS

Figure 1:
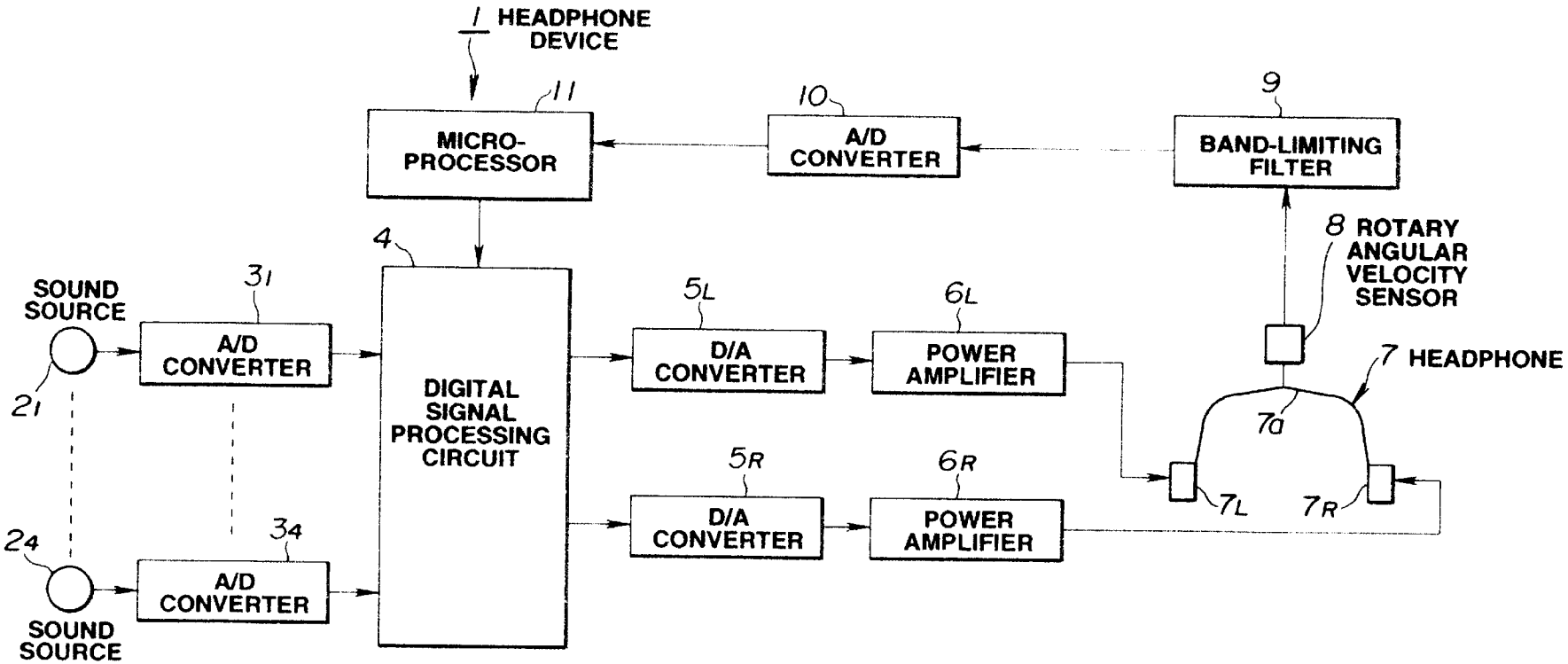
FIG. 1 is a block diagram showing a first embodiment of a headphone device according to the present invention.

Referring to the drawings, certain preferred embodiments of the headphone device according to the present invention will be explained in detail.

The headphone device 1 of the first embodiment, shown in FIG. 1, has a digital signal processing circuit 4 for receiving speech input signals from four sound sources $\mathbf{2}_1$ to $\mathbf{2}_4$, placed at such positions as to localize speech input signals of, for example, four channels, as digital signals via four A/D converters $\mathbf{3}_1$ to $\mathbf{3}_4$ and for processing the speech input digital signals of the four channels by digital signal processing, and power amplifiers $\mathbf{6}_L$, $\mathbf{6}_R$ for splitting the speech digital signals processed by the digital signal processing circuit 4 with digital signal processing and for receiving the digital speech signals as analog signals via D/A converters $\mathbf{5}_L$, $\mathbf{5}_R$ for power amplification. The headphone device also includes a headphone 7 having sound producing elements or enunciators $\mathbf{7}_L$, $\mathbf{7}_R$ driven by the power amplifiers $\mathbf{6}_L$, $\mathbf{6}_R$ and a rotary angular velocity sensor 8 mounted on a head band 7*a* of the headphone 7 for detecting the rotary angular velocity of the head of the user of the headphone 7. The headphone device further includes a micro-processor 11 having a rotary angle calculating function consisting of bandwidth-limiting a detection output of the rotary angular velocity sensor 8 by a bandwidth limiting filter 9, converting the resulting output into a digital signal by an A/D converter 10 and calculating the angle of rotational movement from the front direction of the headphone user. The signal processing contents in the digital signal processing circuit 4 are updated responsive to the rotational angle obtained by the micro-processor 11 for localizing the sound image in a pre-set direction outside the head of the headphone user.

When the headphone 7 performs a rotary movement, the rotary angular velocity sensor 8 mounted on the headband 7*a* outputs a voltage proportionate to the angular velocity. This output signal is filtered by a band-limiting filter 9 and encoded by an A/D converter 10 before entering the micro-processor 11. The output signal of the A/D converter 10, entering the micro-processor 11, is sampled at a pre-set time interval and integrated so as to be converted into angular data. From the angular data, a rotary angle for actually localizing the sound image is calculated and the resulting processed data is transmitted to the digital signal processing circuit 4.

The four-channel speech signals entering the four sound sources $\mathbf{2}_1$ to $\mathbf{2}_4$ are encoded by four A/D converters $\mathbf{3}_1$ to $\mathbf{3}_4$ before entering the digital signal processor 4. The digital signal processing circuit 4 performs digital signal processing for localizing the required speech signals outside the head in accordance with the angular data calculated by the micro-processor 11, and outputs the results to the two D/A converters $\mathbf{5}_L$ and $\mathbf{5}_R$ associated with the stereo L and R channels, respectively. The speech signals, again converted by the two D/A converters $\mathbf{5}_L$ and $\mathbf{5}_R$, are supplied via power amplifiers $\mathbf{6}_L$, $\mathbf{6}_R$ to the speech enunciators $\mathbf{7}_L$, $\mathbf{7}_R$ of the headphone 7 for furnishing an optimum outside-head localized signal to the listener.

Figure 2:
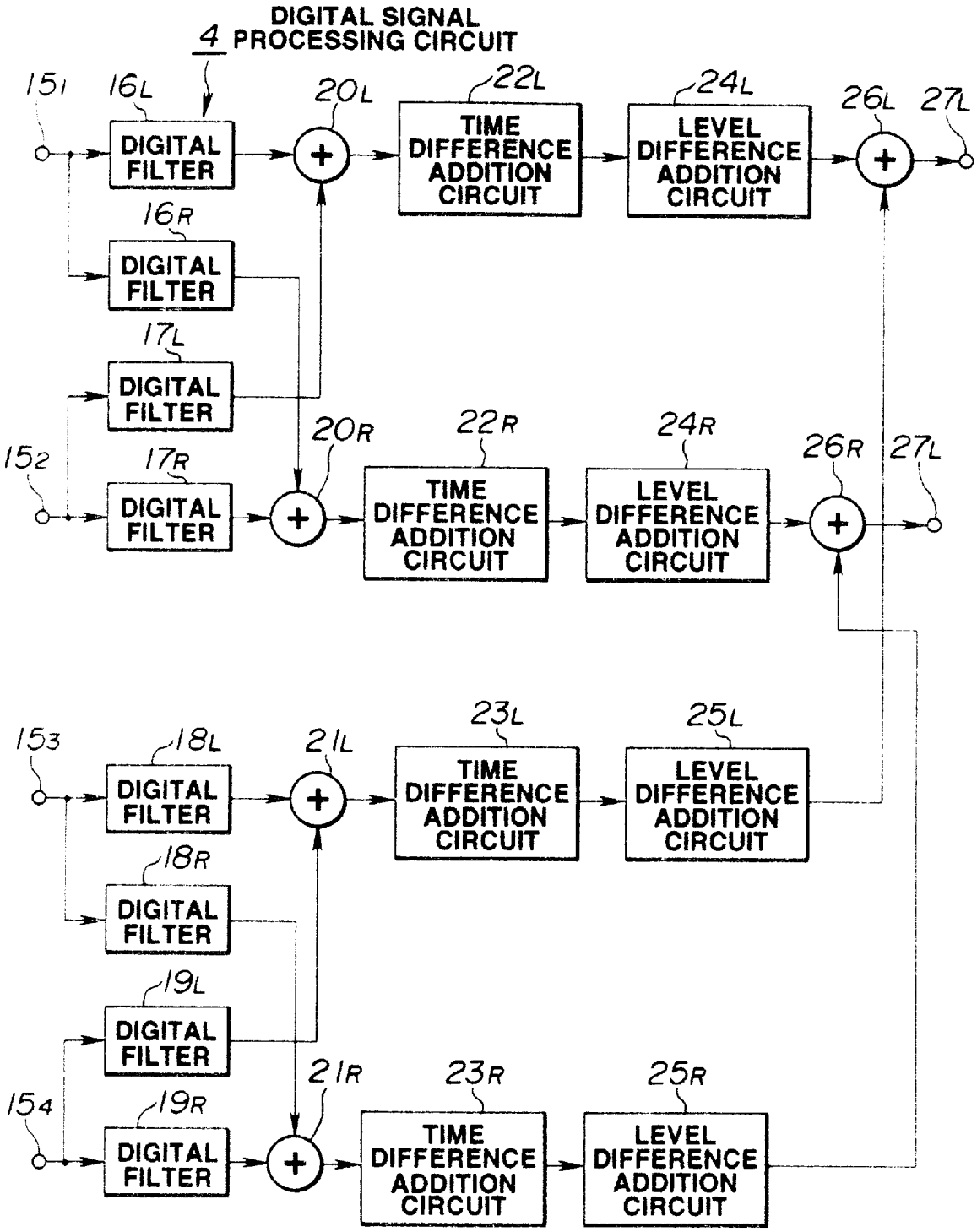
FIG. 2 is a block view showing a digital signal processing circuit employed in the embodiment of FIG. 1.

Referring to FIG. 2, the digital signal processing circuit 4 includes eight digital filters $\mathbf{16}_L$, $\mathbf{16}_R$, $\mathbf{17}_L$, $\mathbf{17}_R$, $\mathbf{18}_L$, $\mathbf{18}_R$, $\mathbf{19}_L$, $\mathbf{19}_R$ for convolving impulse response corresponding to the head transfer function in the time domain, from the four sound sources $\mathbf{2}_1$ to $\mathbf{2}_4$ to both ears of the user, of the four channel speech input digital signal received via input terminals $\mathbf{15}_1$, $\mathbf{15}_2$, $\mathbf{15}_3$, $\mathbf{15}_4$, a first pair of adders $\mathbf{20}_L$, $\mathbf{20}_R$ for summing the same L or R sign outputs of the four digital filters $\mathbf{16}_L$, $\mathbf{16}_R$, $\mathbf{17}_L$, $\mathbf{17}_R$ for two channels supplied from the input terminals $\mathbf{15}_1$, $\mathbf{15}_2$ and a second pair of adders $\mathbf{21}_L$, $\mathbf{21}_R$ for summing the same L or R sign outputs of the four digital filters $\mathbf{18}_L$, $\mathbf{18}_R$, $\mathbf{19}_L$, $\mathbf{19}_R$ for the remaining two channels supplied from the input terminals $\mathbf{15}_3$, $\mathbf{15}_4$. The digital signal processing circuit 4 also includes a first pair of time difference addition circuits $\mathbf{22}_L$, $\mathbf{22}_R$, connected to the first pair of adders $\mathbf{20}_L$, $\mathbf{20}_R$ and a second pair of time difference addition circuits $\mathbf{23}_L$, $\mathbf{23}_R$, connected to the second pair of adders $\mathbf{21}_L$, $\mathbf{21}_R$. The digital signal processing circuit 4 also includes a first pair of time difference addition circuits $\mathbf{22}_L$, $\mathbf{22}_R$ connected to the first pair of adders $\mathbf{20}_L$, $\mathbf{20}_R$ and a second pair of time difference addition circuits $\mathbf{23}_L$, $\mathbf{23}_R$ connected to the second pair of adders $\mathbf{21}_L$, $\mathbf{21}_R$. The digital signal processing circuit 4 also includes a second pair of level difference addition circuits $\mathbf{24}_L$, $\mathbf{24}_R$ connected to the first pair of time difference addition circuits $\mathbf{22}_L$, $\mathbf{22}_R$ and a second pair of level difference addition circuits $\mathbf{25}_L$, $\mathbf{25}_R$ connected to the second pair of time difference addition circuits $\mathbf{23}_L$, $\mathbf{23}_R$. The digital signal processing circuit 4 also includes a third pair of adders $\mathbf{26}_L$, $\mathbf{26}_R$ for summing the same sign outputs of the L and R side channels of the first pair of the level difference addition circuits $\mathbf{24}_L$, $\mathbf{24}_R$ and the second pair of the level difference addition circuits $\mathbf{25}_L$, $\mathbf{25}_R$. The digital signal processing circuit 4 reverses the increasing/decreasing direction of the time differences added by the first pair of the time difference addition circuit $\mathbf{22}_L$, $\mathbf{22}_R$ and the second pair of the time difference addition circuits $\mathbf{23}_L$, $\mathbf{23}_R$ and reverses the increasing/decreasing direction of the level differences added by the first pair of the level difference addition circuit $\mathbf{24}_L$, $\mathbf{24}_R$ and the second pair of the time difference addition circuits $\mathbf{25}_L$, $\mathbf{25}_R$.

Figure 3:
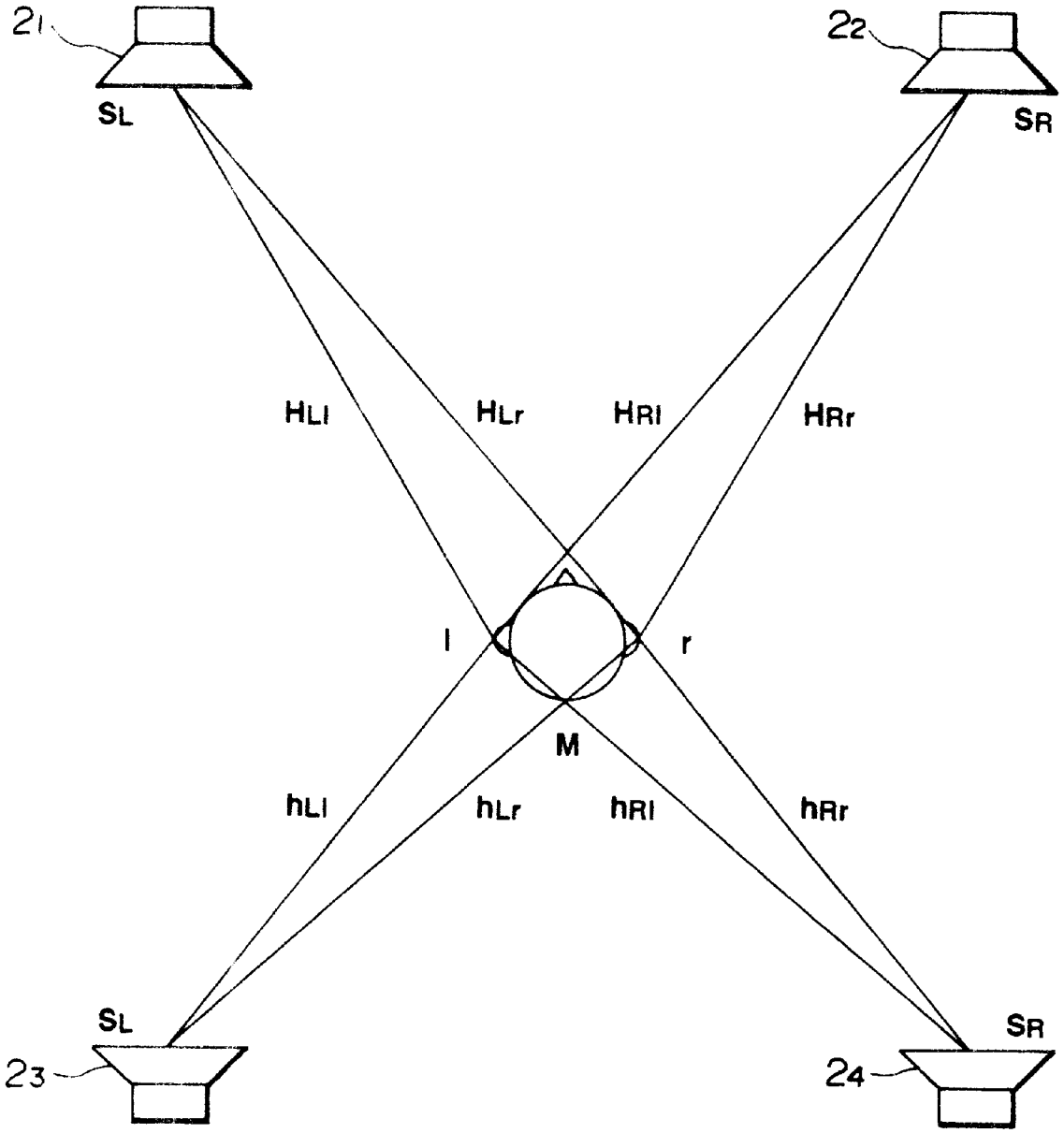
FIG. 3 is a schematic view showing the state assumed with the embodiment of FIG. 1.

The present digital signal processing circuit 4 presumes the state shown in FIG. 3, and routes driving signals to the speech enunciators $\mathbf{7}_L$, $\mathbf{7}_R$ of the headphone device 7. That is, two channels from sound sources $\mathbf{2}_1$ and $\mathbf{2}_2$ which should be localized in a front angular range of 180° are presumed, while two channels from sound sources $\mathbf{2}_3$ and $\mathbf{2}_4$ which should be localized in a rear angular range of 180° are presumed, so that the number of channels is four.

As for the speech input digital signals entering input terminals $\mathbf{15}_1$, $\mathbf{15}_2$, the impulse response corresponding to the head transfer function from the sound sources $\mathbf{2}_1$, $\mathbf{2}_2$ corresponding to the localization to a forward direction in the initial state is convolved by digital filters $\mathbf{16}_L$, $\mathbf{16}_R$, $\mathbf{17}_L$, $\mathbf{17}_R$. The L-side outputs are summed by an adder $\mathbf{20}_L$ so as to be outputted via time difference addition circuit $\mathbf{22}_L$ and level difference addition circuit $\mathbf{24}_L$ to an adder $\mathbf{26}_L$, while the R-side outputs are summed by an adder $20_R$ so as to be outputted via time difference addition circuit $22_R$ and level difference addition circuit $24_R$ to an adder $26_R$.

Referring to FIG. 3, head transfer functions $H_{Ll}$, $H_{Lr}$, $H_{Rl}$, $H_{Rr}$, are considered as head transfer functions from the sound sources $2_1$, $2_2$ to both ears l, r of a listener M. The sound corresponding to the impulse response convolved by the digital filters $16_L$, $16_R$, $17_L$, $17_R$ is supplied by the headphone 7 to the user so that $S_LH_{Ll}+S_RH_{Rl}$ and $S_RH_{Rr}+S_LH_{Lr}$ will be supplied to the left and right ears l, r of a listener M.

If the listener M moves the head leftwards, for example, the left ear l is moved away from the sound sources $2_1$, $2_2$, while the right ear r is moved towards the sound sources $2_1$, $2_2$. Consequently, the time difference and the level difference are produced in the input speech signal reaching the left and right ears l, r. It is the above-mentioned first pair of the time difference addition circuits $22_L$, $22_R$ and first pair of the level difference addition circuits $24_L$, $24_R$, that produce the time difference and the level difference, respectively.

Figure 4:
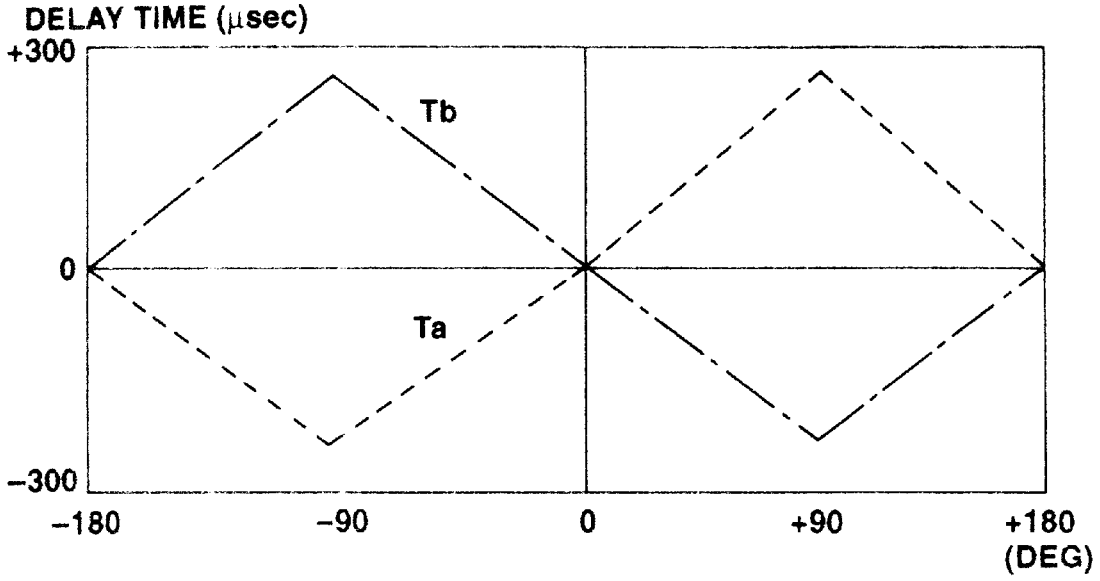
FIG. 4 is a graph showing the delay time added in the time difference addition circuit within the digital signal processing circuit employed in the embodiment of FIG. 1.

The delay time added by the L-side time difference addition circuit $22_L$ is represented by a chain-dotted line curve $T_b$ for delay time characteristics of FIG. 4, while the delay time added by the R-side time difference addition circuit $22_L$ is represented by a broken line curve $T_a$ for delay time characteristics of FIG. 4. The curves $T_a$, $T_b$ have totally opposite increasing and decreasing directions with respect to the rotational direction of the head of the listener M. The result is that time changes from the sound sources to both ears which are the same as those perceived by the listener M listening to the sound from the sound sources placed within the reach of forward 180° as he or she rotates their head towards left or right are added to the signals entering the input terminals $15_1$, $15_2$ even when employing the headphone 7.

Figure 5:
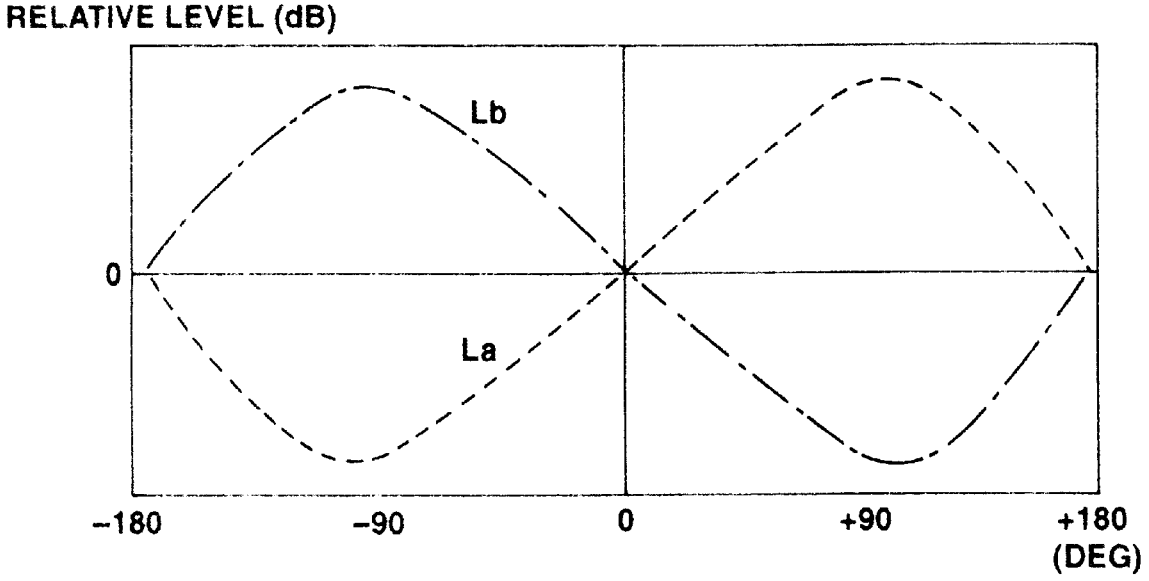
FIG. 5 is a graph showing the level difference added in the level difference addition circuit within the digital signal processing circuit employed in the embodiment of FIG. 1.

The level difference added by the L-side difference addition circuit $24_L$ is denoted by a broken-line curve $L_a$ having the relative level characteristics shown in FIG. 5, showing the relative level from the head rotary angle of 0°, while the level difference added by the R-side difference addition circuit $24_R$ is denoted by a chain-dotted line curve $L_b$ having relative level characteristics shown in FIG. 5. The characteristic curves $L_a$, $L_b$ have the totally opposite increasing and decreasing directions with respect to the turning direction of the listener's head. That is, since the level difference addition circuits $24_L$, $24_R$ add level changes of the characteristic curves $L_a$, $L_b$, respectively, sound volume changes similar to those when hearing the forward sound sources are added to the input signals from the input terminals $15_1$, $15_2$ for the headphone user.

Similarly, as for the speech input digital signals, entering input terminals $15_3$, $15_4$, the impulse response corresponding to the head transfer function from the sound sources $2_3$, $2_4$ corresponding to localization to a forward direction in the initial state is convolved by digital filters $18_L$, $18_R$, $19_L$, $19_R$. The L-side outputs are summed by the adder $21_L$ so as to be outputted via time difference addition circuit $23_L$ and level difference addition circuit $25_L$ to the adder $26_L$, while the R-side outputs are summed by an adder $21_R$ so as to be outputted via time difference addition circuit $23_R$ and level difference addition circuit $25_R$ to the adder $26_R$.

Referring to FIG. 3, head transfer functions $h_{Ll}$, $h_{Lr}$, $h_{Rl}$, $h_{Rr}$ are considered as head transfer functions from the sound sources $2_3$, $2_4$ to both ears l, r of the listener M. The sound corresponding to the impulse response convolved by the digital filters $18_L$, $18_R$, $19_L$, $19_R$ is supplied by the headphone 7 to the user so that $s_LH_{Ll}+s_Rh_{Rl}$ and $s_Rh_{Rr}+s_Lh_{Lr}$ will be supplied to the left and right ears l, r of the listener M.

If the listener M moves the head leftwards, for example, the left hear l is moved away from the sound sources $2_1$, $2_2$, while the right hear r is moved towards the sound sources $2_1$, $2_2$. Consequently, the time difference and the level difference are produced in the input speech signal reaching the left and right ears l, r. Via the above-mentioned second pair of the time difference addition circuits $23_L$, $23_R$ and second pair of the level difference addition circuits $25_L$, $25_R$, respectively.

The delay time added by the L-side time difference addition circuit $23_L$ is represented by a broken line curve $T_a$ for delay time characteristics of FIG. 4, while the delay time added by the R-side time difference addition circuit $23_R$ is represented by a chain-dotted line curve $T_b$ for delay time characteristics of FIG. 4. The curves $T_a$, $T_b$ have totally reversed increasing and decreasing directions with respect to the rotational direction of the head of the listener M. The result is that time changes from the sound sources to both ears which are the same as those perceived by the listener M listening to the sound from the sound sources placed within the reach of forward 180. as the listener rotates his or her head towards left or right are added to the signals entering the input terminals $15_1$, $15_2$ even when employing the headphone 7.

The level difference added by the L-side difference addition circuit $25_L$ is denoted by a chain-dotted line curve $L_b$ having the relative level characteristics shown in FIG. 5, while the level difference added by the R-side difference addition circuit $25_R$ is denoted by a broken line curve $L_a$ having the relative level characteristics shown in FIG. 5. The characteristic curves $L_b$, $L_a$ have the totally reversed increasing and decreasing directions with respect to the turning direction of the listener's head, as explained previously. That is, since the level difference addition circuits $25_L$, $25_R$ add level changes of the characteristic curves $L_b$, $L_a$, respectively, sound volume changes similar to those when hearing the rear sound sources are added to the input signals from the input terminals $15_3$, $15_4$ for the headphone user.

As may be seen from above, with the headphone device of the present embodiment, the sound images of higher quality may be simultaneously localized in both the forward and rear directions.

The digital signal processor 4 of the present headphone device 1 may be configured as shown in FIGS. 2, 6, 8 and 10.

Figure 6:
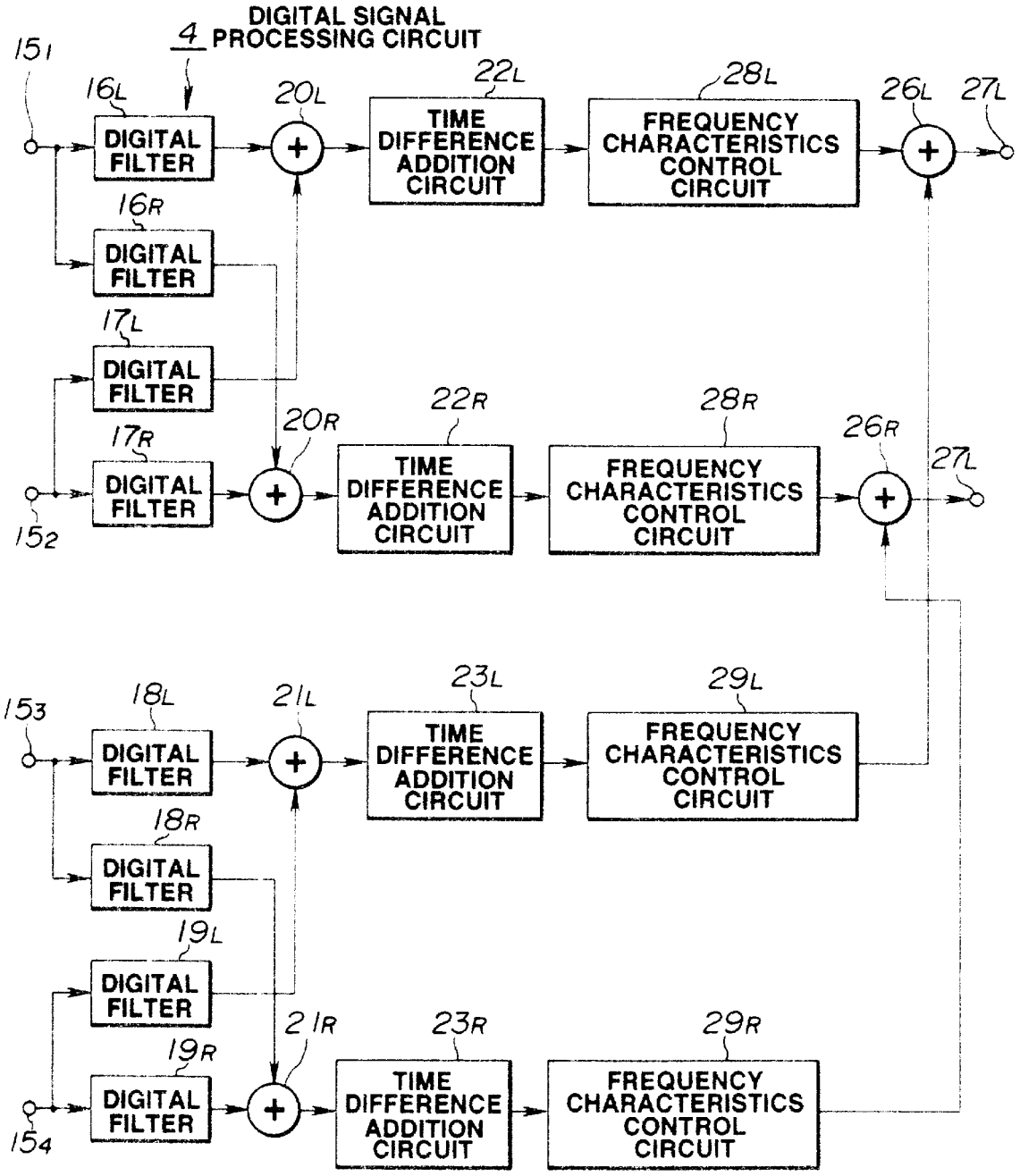
FIG. 6 is a block diagram showing the digital signal processing circuit employed in the embodiment of FIG. 1 and which uses the time difference addition circuit and the frequency characteristics controlling circuit.

In the digital signal processor 4 shown in FIG. 6, a first pair of frequency characteristics control circuit $28_L$, $28_R$ are connected to the outputs of the first pair of time difference addition circuits $22_L$, $22_R$ in place of the first pair of the level difference addition circuits $24_L$, $24_R$, respectively, while a second pair of frequency characteristics control circuit $29_L$, $29_R$ are connected to the outputs of the second pair of time difference addition circuits $23_L$, $23_R$ in place of the first pair of the level difference addition circuits $25_L$, $25_R$, respectively.

Figure 7:
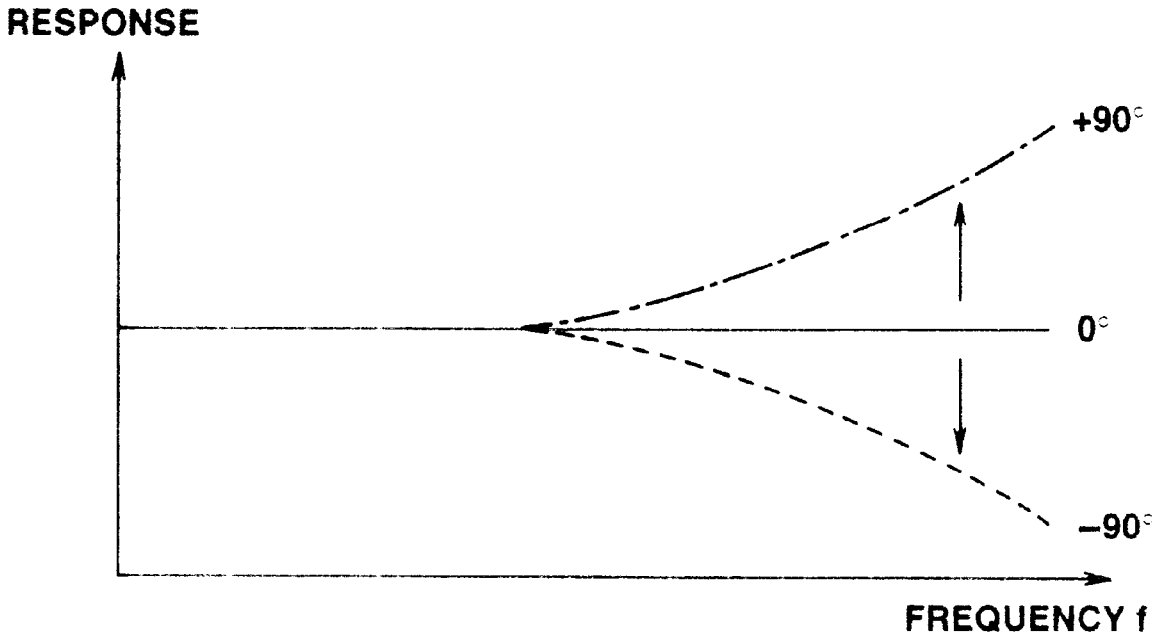
FIG. 7 is a graph showing frequency control carried out in the frequency characteristics controlling circuit.

The first pair of the frequency characteristics control circuit $28_L$, $28_R$ and the second pair of the frequency characteristics control circuit $29_L$, $29_R$ accord frequency characteristics shown in FIG. 7 to the input signal depending on the turning angle of the headphone user for controlling frequency characteristics. If the head remains fixed in the front forward direction (0° direction), the response remains constant even if the frequency f becomes higher, as indicated by a solid line. If the head is turned towards right by 90° or towards left by 90°, there is produced a response difference as the frequency f becomes higher. If the head is turned by 90° towards right (+90° direction), the response is increased as the frequency f becomes higher, as indicated by a chain-dotted line. Conversely, if the head is turned by 90° towards left (−90° direction), the response is decreased as the frequency f becomes higher, as indicated by a broken line. The response characteristics are vertically symmetrical with respect to the response characteristics shown by a solid line representing the case wherein the head is fixed in the front direction. In addition, the frequency characteristics are reversed when the sound source is placed in a range of forward 180° angular range to those when the sound source is placed within a range of rear 180°.

Therefore, with the headphone device 1 employing the digital signal processor 4 shown in FIG. 6, since the first pair of the time difference addition circuits $\mathbf{22}_L$, $\mathbf{22}_R$ and the second pair of the time difference addition circuits $\mathbf{23}_L$, $\mathbf{23}_R$ reverse the increasing/decreasing direction of the time difference added responsive to the turning angle of the head of the user, while the first pair of the frequency characteristics control circuits $\mathbf{28}_L$, $\mathbf{28}_R$ and the second pair of the frequency characteristics control circuits $\mathbf{29}_L$, $\mathbf{29}_R$ reverse the changing direction of the frequency characteristics to be controlled responsive to the turning angle of the head, it becomes possible to realize frequency characteristics and the time difference between both ears equivalent to those when hearing the actual sound from the forward sound signal and the rear sound signal as the user moves his or her head, and hence an optimum outside-head sound image localized sense may be achieved in all directions.

Figure 8:
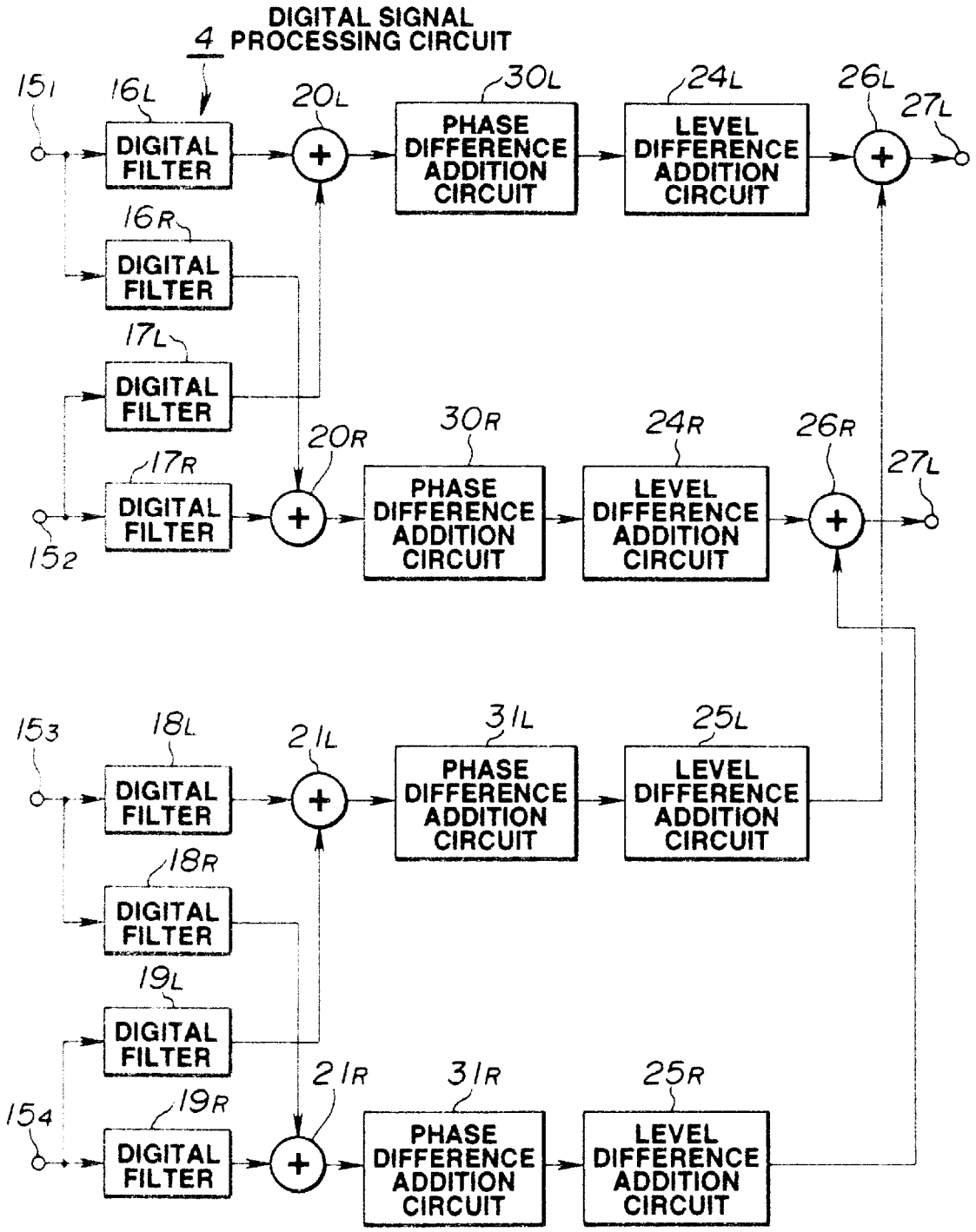
FIG. 8 is a block diagram showing the digital signal processing circuit which is used in the embodiment of FIG. 1 and which has a phase difference addition circuit and a level difference addition circuit.

In the digital signal processor 4 shown in FIG. 8, a first pair of phase difference addition circuits $\mathbf{30}_L$, $\mathbf{30}_R$ are connected to the inputs of the first pair of level difference addition circuits $\mathbf{24}_L$, $\mathbf{24}_R$ in place of the first pair of the time difference addition circuits $\mathbf{22}_L$, $\mathbf{22}_R$, respectively, while a second pair of phase difference addition circuits $\mathbf{31}_L$, $\mathbf{31}_R$ are connected to the inputs of the second pair of level difference addition circuits $\mathbf{25}_L$, $\mathbf{25}_R$ in place of the first pair of the time difference addition circuits $\mathbf{23}_L$, $\mathbf{23}_R$, respectively. The first pair of the phase difference addition circuits $\mathbf{30}_L$, $\mathbf{30}_R$ and the second pair of the phase difference addition circuit $\mathbf{31}_L$, $\mathbf{31}_R$ accord a phase difference corresponding to phase change characteristics shown in FIG. 9 to the input signal depending on the turning angle of the headphone user. If the head remains fixed in the forward front direction (0° direction), the phase difference becomes equal to 0° as shown by a solid line. If, however, the head is turned 90° towards right and left, the phase difference is shifted towards left and right, respectively. If the head is turned by 90° towards right (+90. direction), the phase is advanced as indicated by a chain-dotted line. Conversely, if the head is turned by 90° towards left (−90° direction), the phase is delayed as indicated by a broken line. The two response characteristics are symmetrical relative to each other in the left-and-right direction on both sides of the response characteristics for a case in which the head is fixed in the forward direction, as indicated by solid line. In addition, these characteristics are reversed when the sound source is placed in a range of forward 180° to those when the sound source is placed in a range of rear 180°.

Therefore, with the headphone device 1 employing the digital signal processor 4 shown in FIG. 8, since the first pair of the phase difference addition circuits $\mathbf{30}_L$, $\mathbf{30}_R$ and the second pair of the phase difference addition circuits $\mathbf{31}_L$, $\mathbf{31}_R$ reverse the increasing/decreasing direction of the time difference added responsive to the turning angle of the head of the user, while the first pair of the level difference addition circuits $\mathbf{24}_L$, $\mathbf{24}_R$ and the second pair of the level difference addition circuits $\mathbf{25}_L$, $\mathbf{25}_R$ reverse the changing direction of the frequency characteristics to be controlled responsive to the turning angle of the head, it becomes possible to realize level difference characteristics and the phase difference characteristics between both ears equivalent to those when hearing the actual sound from the forward sound signal and the rear sound signal as the user moves his or her head, and hence an optimum outside-head sound image localized feeling may be achieved in all directions.

Figure 10:
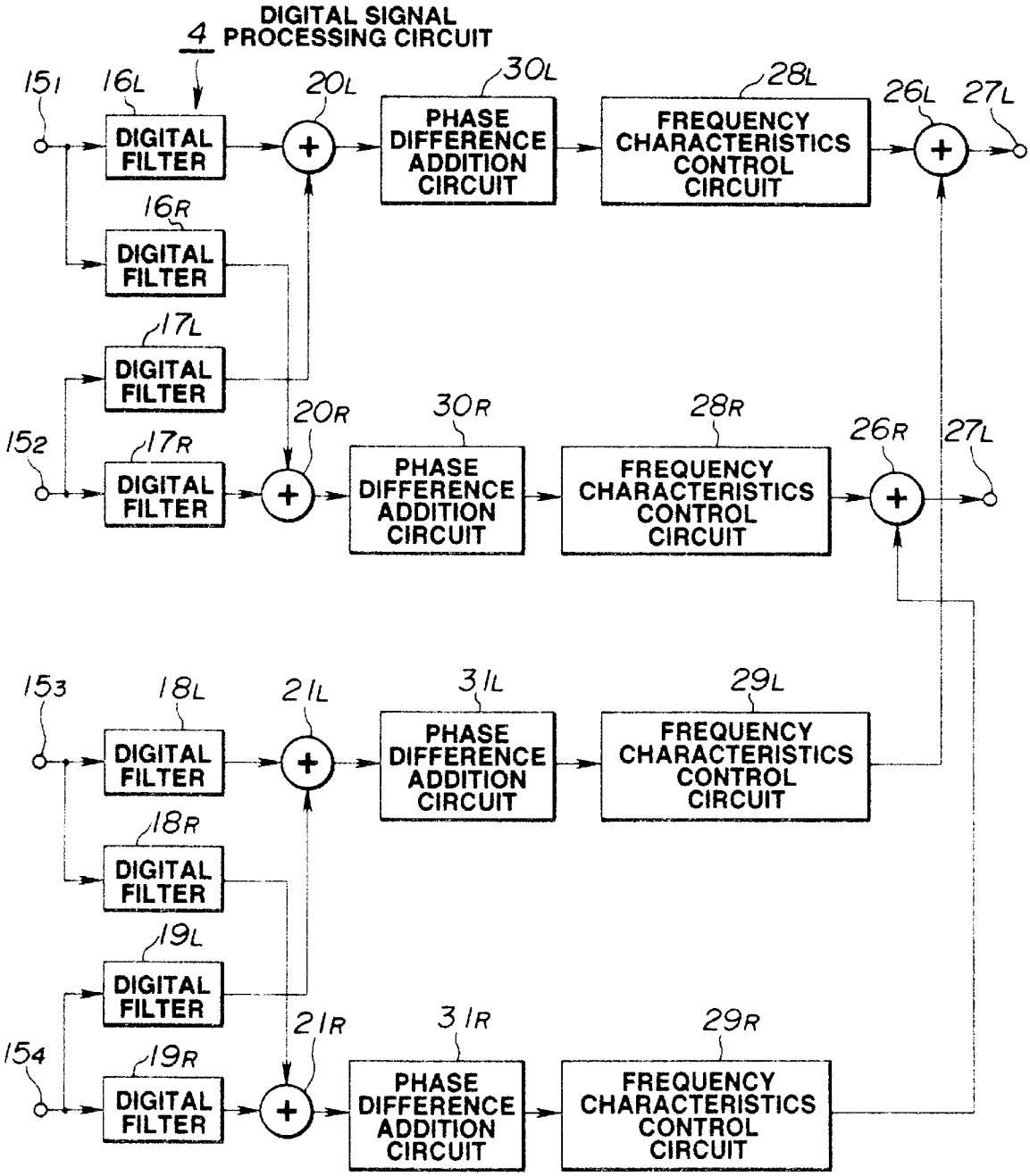
FIG. 10 is a block diagram showing the digital signal processing circuit employed in the embodiment of FIG. 1 and which uses the phase difference addition circuit and the frequency characteristics controlling circuit.

In the digital signal processor 4 shown in FIG. 10, a first pair of phase difference addition circuit $\mathbf{30}_L$, $\mathbf{30}_R$ are connected to the outputs of the first pair of frequency characteristics control circuits $\mathbf{28}_L$, $\mathbf{28}_R$ in place of the first pair of the time difference addition circuits $\mathbf{22}_L$, $\mathbf{22}_R$ of FIG. 6, respectively, while a second pair of phase difference addition circuit $\mathbf{31}_L$, $\mathbf{31}_R$ are connected to the outputs of the first pair of frequency characteristics control circuits $\mathbf{29}_L$, $\mathbf{29}_R$ in place of the second pair of the time difference addition circuits $\mathbf{23}_L$, $\mathbf{23}_R$ of FIG. 6, respectively.

Figure 9:
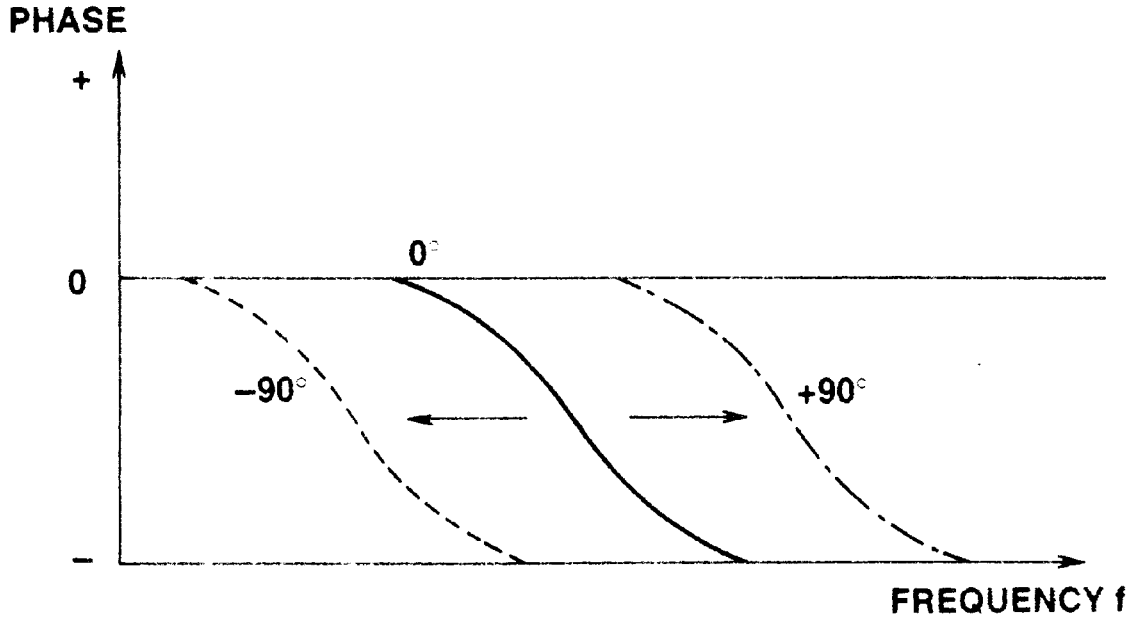
FIG. 9 is a graph showing changes in phase difference added in the phase difference addition circuit.

The first pair of the phase difference addition circuit $\mathbf{30}_L$, $\mathbf{30}_R$ and the second pair of the phase difference addition circuit $\mathbf{31}_L$, $\mathbf{31}_R$ accord a phase difference shown in FIG. 9 to the input signal depending on the turning angle of the headphone user corresponding to phase change characteristics shown in FIG. 9.

The first pair of the frequency characteristics control circuit $\mathbf{28}_L$, $\mathbf{28}_R$ and the second pair of the frequency characteristics control circuit $\mathbf{29}_L$, $\mathbf{29}_R$ accord frequency characteristics shown in FIG. 7 to the input signal depending on the turning angle of the head of the headphone user for controlling frequency characteristics.

Therefore, with the headphone device 1 employing the digital signal processor 4 shown in FIG. 10, the increasing/decreasing direction of the phase difference added by the first pair of the phase difference addition circuits $\mathbf{30}_L$, $\mathbf{30}_R$ and the second pair of the phase difference addition circuits $\mathbf{31}_L$, $\mathbf{31}_R$ responsive to the turning angle of the head is reversed and accorded to the input signals from the four sound sources, that is the forward two channels and the rear two channels, while the changing direction of the frequency characteristics controlled by the first pair of the frequency characteristics control circuits $\mathbf{28}_L$, $\mathbf{28}_R$ and the second pair of the frequency characteristics control circuits $\mathbf{29}_L$, $\mathbf{29}_R$ responsive to the turning angle of the head is reversed. Thus it becomes possible to realize phase difference characteristics between both ears and the frequency characteristics equivalent to those when hearing the actual sound from the forward sound signal and the rear sound signal as the user moves his or her head, and hence an optimum outside-head sound image localized feeling may be achieved in all directions.

Figure 11:
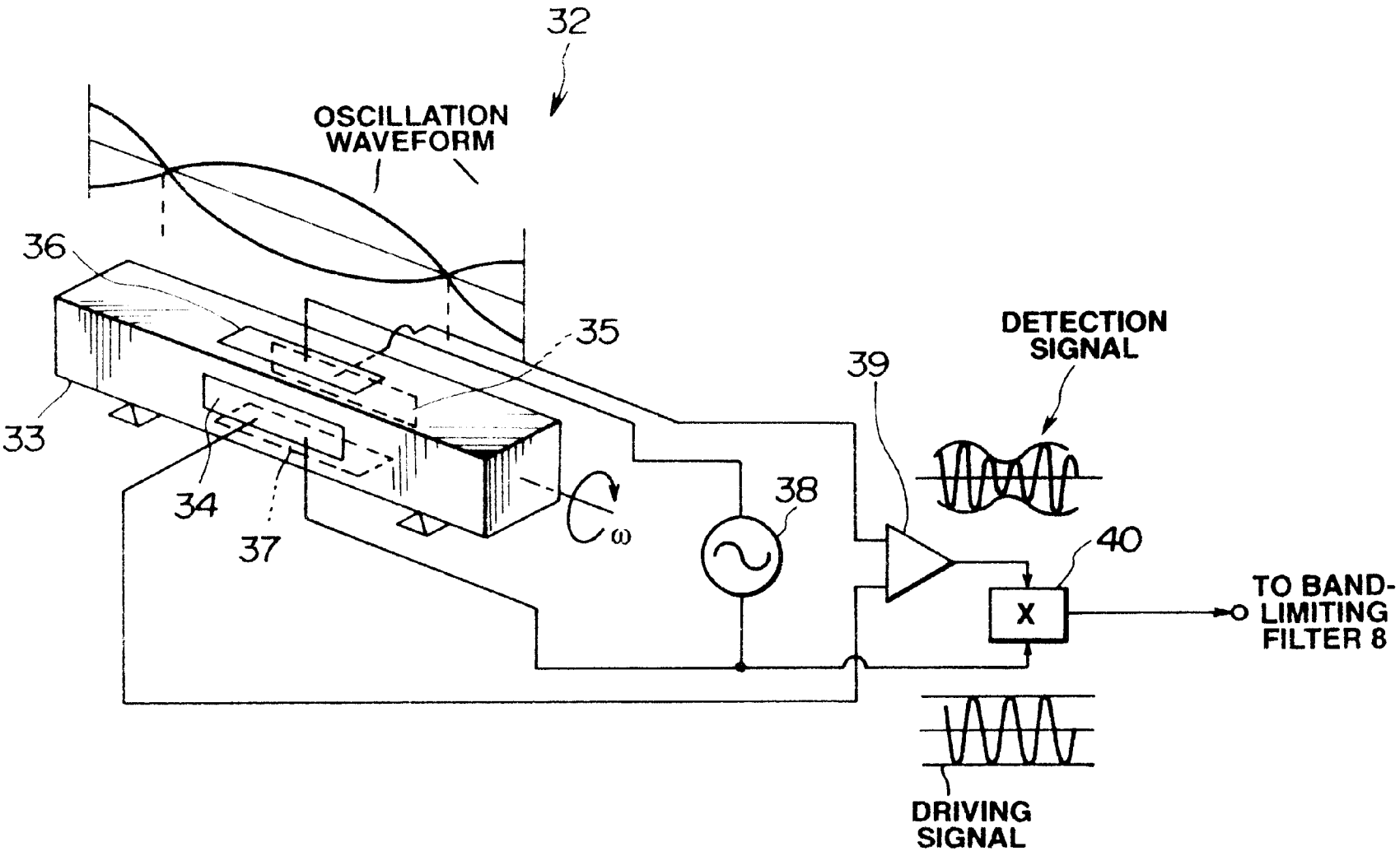
FIG. 11 is a schematic view showing a piezoelectric vibration gyro applicable to a rotational angular sensor employed in the embodiment of FIG. 1.

The rotary angular velocity sensor 8 shown in FIG. 1 is now explained. The rotary angular velocity sensor 8 senses the rotary angular velocity of the head of the user of the headphone 7. Specifically, the headphone device 1 of the present embodiment uses a piezoelectric vibration gyro sensor 32 shown in FIG. 11 as the rotary angular velocity sensor 8. The piezoelectric vibration gyro sensor 32 senses the vibrating movement of the moving object of a piezoelectric element. In FIG. 11, a piezoelectric element for vibration 33 formed by a regular parallelepiped for vibration, is made up of a variety of vibrating members. On opposing surfaces of the piezoelectric element for vibration are mounted piezoelectric elements 34, 35 for detection and piezoelectric elements for detection 36, 37 for driving.

To the piezoelectric elements for detection 36, 37 for driving is connected a driving signal source 38 for supplying an alternating signal. An output of the piezoelectric elements 34, 35 for detection is supplied to a differential amplifier 39. A differential output of the differential amplifier 39 and an output of the driving signal source 38 are supplied to a multiplier or phase detector 40 for multiplication or phase detection. An output of the multiplier or the phase detector 40 is supplied to the bandwidth limiting filter 9 shown in FIG. 9 and thereby free of carrier wave components. The resulting signal is supplied to and encoded by the A/D converter 10.

The piezoelectric gyro device 32, arranged as described above, operates as follows: If alternating signals of a fixed oscillation frequency proper to the piezoelectric element for vibration 33 are applied to the piezoelectric elements for detection 36, 37, the piezoelectric element for vibration 33 is forced into vibrations based on the illustrated oscillation waveform. These vibrations generate resonant vibrations at a constant mode.

If, in such case, no external force is applied, there is no output of the piezoelectric element for detection 34. However, if a rotary force of an angular velocity $\omega$ is applied to the piezoelectric element for vibration 33 in its axial direction, the alternating signals for forced oscillations, as a carrier wave, are amplitude-modulated under the Coriolis force and detected as detection signals. The amplitude value at this time is proportionate to the rotary angular velocity $\omega$ of the rotation applied to the shaft, with the direction of rotation corresponding to the direction of phase deviation of the detection signal relative to the driving signal.

Therefore, it has been practiced to find a product of the amplitude-modulated detection signal with the driving signal and to pass the product signal thus found through the band-limiting filter 9 as a low-pass filter to remove the carrier wave component to derive a detection signal.

Figure 12:
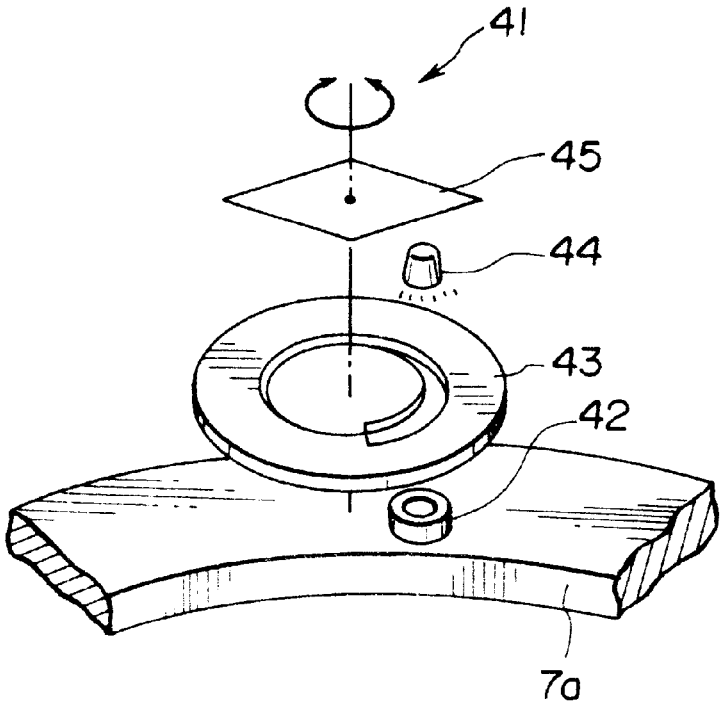
FIG. 12 is a schematic view showing an analog angular sensor applicable to a rotational angular sensor employed in the embodiment of FIG. 1.

The rotary angular velocity sensor 8 may also be an analog angular sensor 41 shown in FIG. 12. The analog angular sensor 41 is provided on a headband 7*a* of the headphone 7 for detecting head movement. The rotary angular velocity sensor 8 carries a light receiving element 42, varied in resistance value with light intensity, such as a CDS or a photodiode, at a mid portion of the headband 7*a*. A light emitting element 44, such as a bulb or LED, is mounted facing the light receiving element 42, and a light beam of a constant light intensity is radiated from the light emitting element 44 towards the light receiving element 42.

On the light path of the light projected by the light emitting element 44 is mounted a movable shutter 43 whose transmittance to the projected light is changed with the rotary angle. This movable shutter 43 is adapted to be rotated with a magnetic needle 45. Therefore, if a constant current flows through the light receiving element 42, an analog output voltage indicating head movement of the headphone user inclusive of his or her direction is issued across both terminals of the light receiving element of the light emitter 42 with the north and south directions indicated by the magnetic needle 45 as a reference direction.

Figure 13:
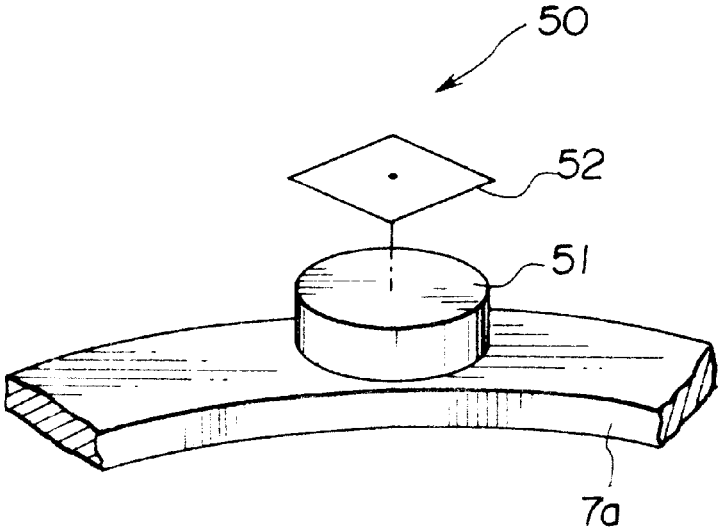
FIG. 13 is a schematic view showing a digital angular sensor applicable to a rotational angular sensor employed in the embodiment of FIG. 1.

The rotary angular velocity sensor 8 may also be a digital angular sensor 50 shown in FIG. 13. This digital angular sensor 50 is provided on the headband 7*a* of the headphone 7 for detection head movement. With the present digital angular sensor 50, a rotary encoder 51 is mounted so that its input shaft is set upright, and the magnetic needle 52 is mounted on the input shaft. Thus, an output indicating head movement of the user inclusive of his or her direction is outputted by the rotary encoder 51, with the north and south direction indicated by the magnetic needle 52 as a reference direction. Since the output is already a digital signal, the band-limiting filters 9 and the A/D converter 10 shown in FIG. 1 may be omitted.

It is also possible with the rotary angular velocity sensor 8 to calculate the rotary angle in terms of an output ratio of the light intensity of the light emitter provided ahead of or around the rotary angular velocity sensor 8 and at least two light intensity sensors provided on the headband of the headphone.

It is likewise possible with the rotary angular velocity sensor 8 to read a burst signal intermittently generated by ultrasonic oscillators provided on the forward or lateral sides with a microphone provided at two different positions on the headphone 7 in order to calculate the rotary angle from the time difference of the respective reception signals.

The band-limiting filter 9, A/D converter 10, micro-processor 11, digital signal processing circuit 4, D/A converters $\mathbf{5}_L$, $\mathbf{5}_R$ and the power amplifiers $\mathbf{6}_L$, $\mathbf{6}_R$, in addition to the rotary angular velocity sensor 8, may be provided on the headphone 7. In such case, speech input signals may be supplied by radio transmission from the A/D converters $\mathbf{3}_1$ to $\mathbf{3}_4$ to the digital signal processing circuit 4.

Of course, the above components other than the rotary angular velocity sensor 8 may be mounted on a portion other than the headphone 7. Output signals may also be supplied from the power amplifiers $\mathbf{6}_L$ and $\mathbf{6}_R$ to speech enunciators $\mathbf{7}_L$ and $\mathbf{7}_R$ of the headphone 7.

Figure 14:
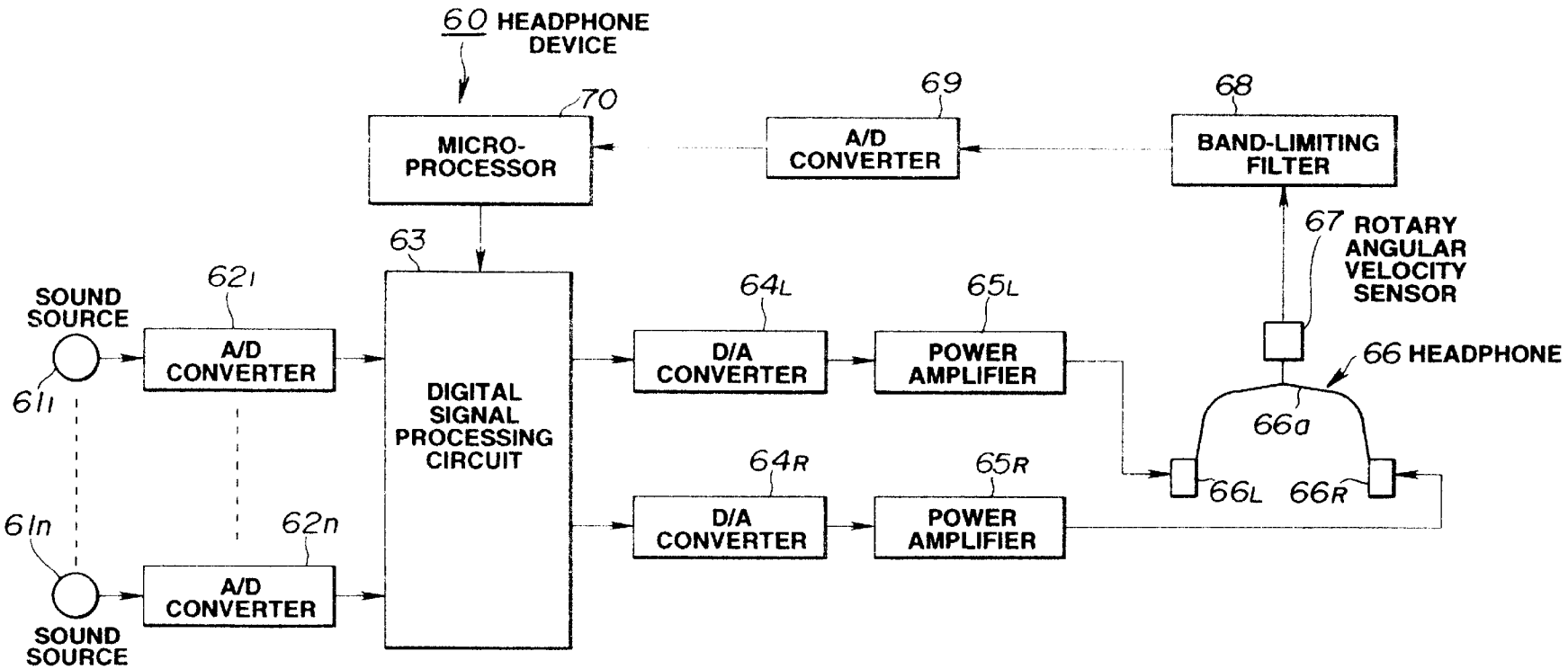
FIG. 14 is a block diagram showing a second embodiment of a headphone device according to the present invention.

The second embodiment of a headphone device 60 of the present invention will be explained. Referring to FIG. 14, the headphone device 60 includes a digital signal processing circuit 63 configured for receiving n-channel speech input signals generated by n sound sources $\mathbf{61}_1$ to $\mathbf{61}_n$ as digital signals over n A/D converters $\mathbf{62}_1$ to $\mathbf{62}_n$, collecting by groups each consisting of four inputs, for example, of the n channel speech input signals as units to form input signal sets and for digitally processing these input signal sets. The headphone device also includes power amplifiers $\mathbf{65}_L$, $\mathbf{65}_R$ configured for power amplifying the analog speech which is converted by D/A converters $\mathbf{64}_L$, $\mathbf{64}_R$ from digital speech signals processed by the digital signal processing circuit 63 and which subsequently is divided as stereo signals into L and R channels. The headphone device also includes a headphone 66 having speech enunciators $\mathbf{66}_L$, $\mathbf{66}_R$ driven by the power amplifiers $\mathbf{65}_L$, $\mathbf{65}_R$ and a rotary angular velocity sensor 67 mounted on a headband 66*a* of the headphone 66 for sensing the rotary angular velocity of the head of the headphone user. The headphone device additionally includes a micro-processor 70 having a rotary angular movement calculation function of calculating the rotary angular velocity from the front direction of the user of the headphone 66 based on a detection output of the rotary angular velocity sensor 67 from band-width limitation by a band-width limiting filter 68 followed by conversion into digital signals by an A/D converter 69. The signal processing contents in the digital signal processing circuit 63 are updated responsive to the rotary angle obtained by the micro-processor 70 for localizing the sound image in a pre-set direction outside the head of the user of the headphone 66.

If the headphone 66 performs a rotary motion, the angular velocity sensor 67 mounted on the headband 66*a* outputs a voltage proportionate to the angular velocity of the angular movement. This output signal is filtered by the band-width limiting filter 68 and encoded by an A/D converter 69 so as to enter the micro-processor 70. An output signal of the A/D converter 69, entering the micro-processor 70, is sampled at a pre-set time interval and integrated so as to be converted into angular data. The rotary angle for localizing the sound image is calculated from these angular data to produce processed data which is transmitted to the digital signal processing circuit 63.

On the other hand, n-channel speech signals, entering the n sound sources $\mathbf{61}_1$ to $\mathbf{61}_n$, are encoded by n A/D converters $\mathbf{62}_1$ to $\mathbf{62}_n$ so as to enter the digital signal processing circuit 63. The digital signal processing circuit 63 performs signal processing as required on the encoded speech signals for localizing speech signals outside the head of the headphone user in association with angular data calculated by the micro-processor 70, and outputs the resulting signals to the two D/A converters $\mathbf{64}_L$, $\mathbf{64}_R$ associated with the L and R channels. The speech signals restored to the analog signals by the D/A converters $\mathbf{64}_L$, $\mathbf{64}_R$ are supplied via power amplifiers $\mathbf{65}_L$, $\mathbf{65}_R$ to the speech enunciators $\mathbf{66}_L$, $\mathbf{66}_R$ of the headphone 66 for supplying an optimum outside-head localized signals to the hearer.

The digital signal processing circuit 63 is divided into plural signal processing blocks $\mathbf{63}_1$, $\mathbf{63}_2$, . . . $\mathbf{63}_{n/4}$ for performing signal processing on the input speech signals classed into plural blocks based on the localization direction, with the state of the headphone user facing the front side as a reference state, as shown in FIG. 15.

Figure 16:
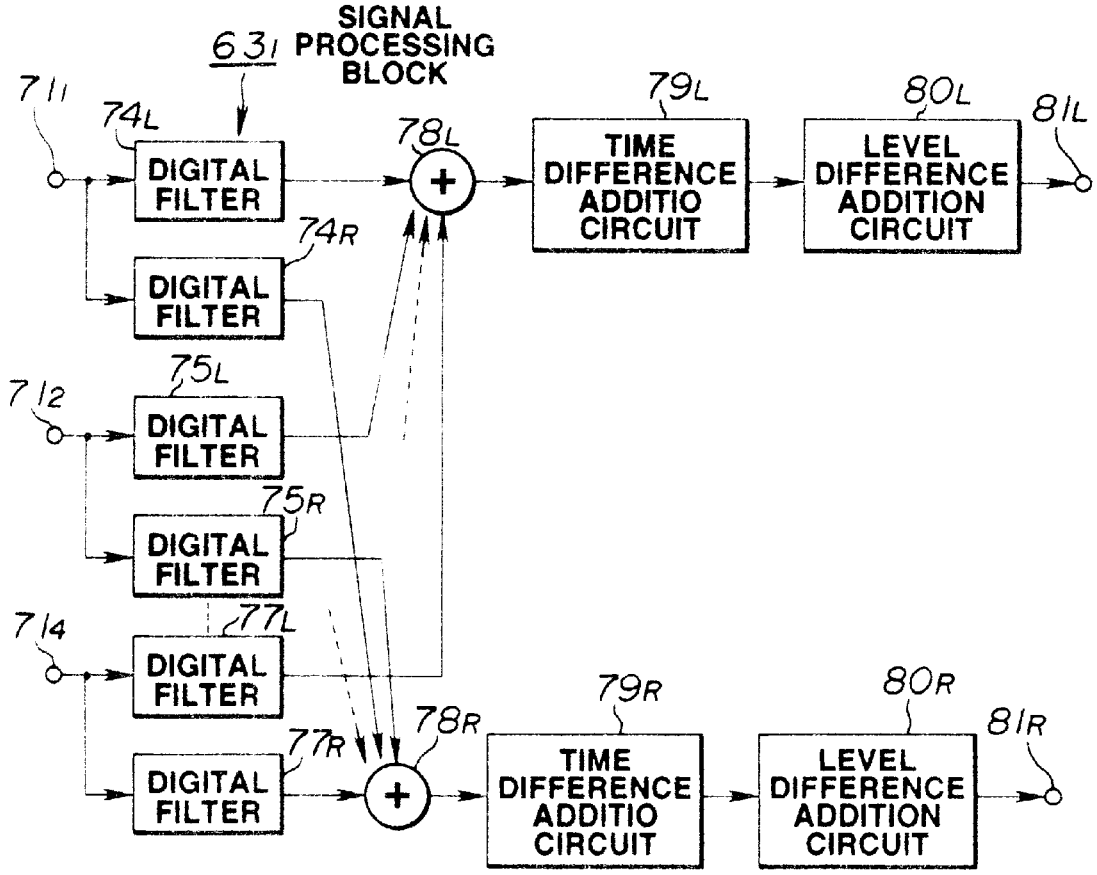
FIG. 16 is a block view showing a digital signal processing block employed in the embodiment of FIG. 14.

For example, the signal processing block $\mathbf{63}_1$ receives four input signals from the sound sources $\mathbf{61}_1$ to $\mathbf{61}_4$ having localization positions close to one another via input terminals $\mathbf{71}_1$, $\mathbf{71}_2$, . . . $\mathbf{71}_4$, as shown in FIG. 16. The four input signals, received via the input terminals $\mathbf{71}_1$, $\mathbf{71}_2$, . . . $\mathbf{71}_4$, are convolved by eight digital filters $\mathbf{74}_L$, $\mathbf{74}_R$, $\mathbf{75}_L$, $\mathbf{75}_R$, $\mathbf{76}_L$, $\mathbf{76}_R$, $\mathbf{77}_L$, $\mathbf{77}_R$, as impulse response converted into time domain from the head transfer function reaching both ears of the headphone user from the four sound sources $\mathbf{61}_1$ to $\mathbf{61}_4$. Filter outputs from digital filters $\mathbf{74}_L$, $\mathbf{74}_R$, $\mathbf{75}_L$, $\mathbf{75}_R$, $\mathbf{76}_L$, $\mathbf{76}_R$, $\mathbf{77}_L$, $\mathbf{77}_R$ are summed by a pair of adders $\mathbf{78}_L$, $\mathbf{78}_R$ for each of the channels L and R so as to be supplied to time difference addition circuits $\mathbf{79}_L$, $\mathbf{79}_R$.

Figure 15:
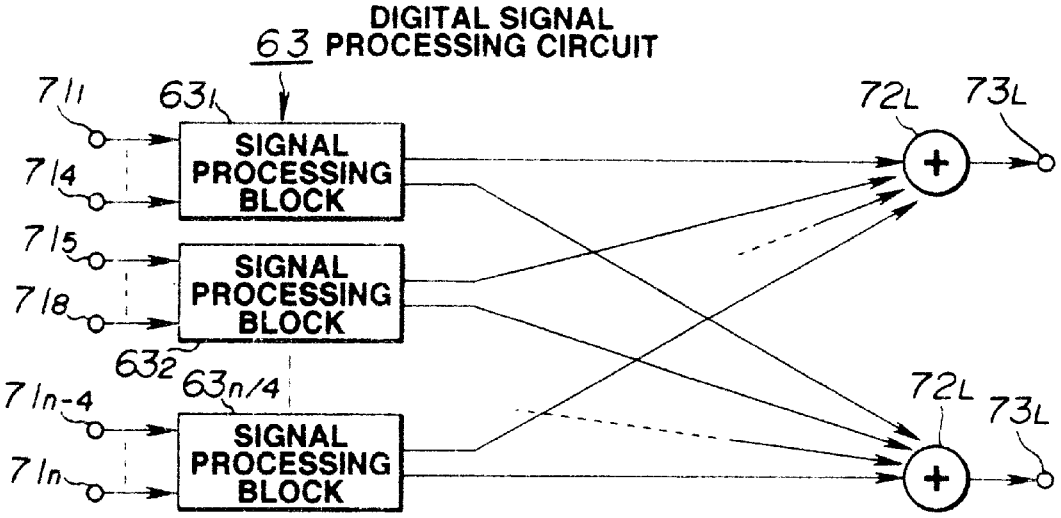
FIG. 15 is a block view showing a digital signal processing circuit employed in the embodiment of FIG. 14.

Outputs of the time difference addition circuits $\mathbf{79}_L$, $\mathbf{79}_R$ are supplied via level difference addition circuits $\mathbf{80}_L$, $\mathbf{80}_R$ and output terminals $\mathbf{81}_L$, $\mathbf{81}_R$ to a pair of adders $\mathbf{72}_L$, $\mathbf{72}_R$ shown in FIG. 15. These adders $\mathbf{72}_L$, $\mathbf{72}_R$ are fed with signals which are filtered by eight digital filters in each of the signal processing blocks $\mathbf{63}_2$, . . . $\mathbf{63}_{n/4}$ and which are added to with time differences and level differences on the L and R basis.

The signals having localization positions close to one another are collected and supplied to a given signal processing block. Thus it becomes possible to accord the same characteristics to the time difference and level difference to be added when the listener turns his or her head with respect to the state of the hearer being directed to a reference direction (0. direction).

Output signals for L and R channels of the respective signal processing blocks are summed by adders $\mathbf{72}_L$, $\mathbf{72}_R$ so as to be output at output terminals $\mathbf{73}_L$, $\mathbf{73}_R$ as output signals to the headphone 66.

It is possible with the headphone device 60 of the second embodiment to achieve sound image localization in an arbitrary direction in case of headphone reproduction by time difference addition and level difference addition independently in each of plural signal processing blocks.

In the present headphone device 60, a phase difference addition circuit may be used in place of the time difference addition circuit. Also the frequency characteristics control circuit may be used in place of the level difference addition circuit.

As the rotary angular velocity sensor 67 employed in the present headphone device 60, the piezoelectric gyro device 32, analog angular velocity sensor 41 or the digital angular sensor 50 may also be employed.

Figure 17:
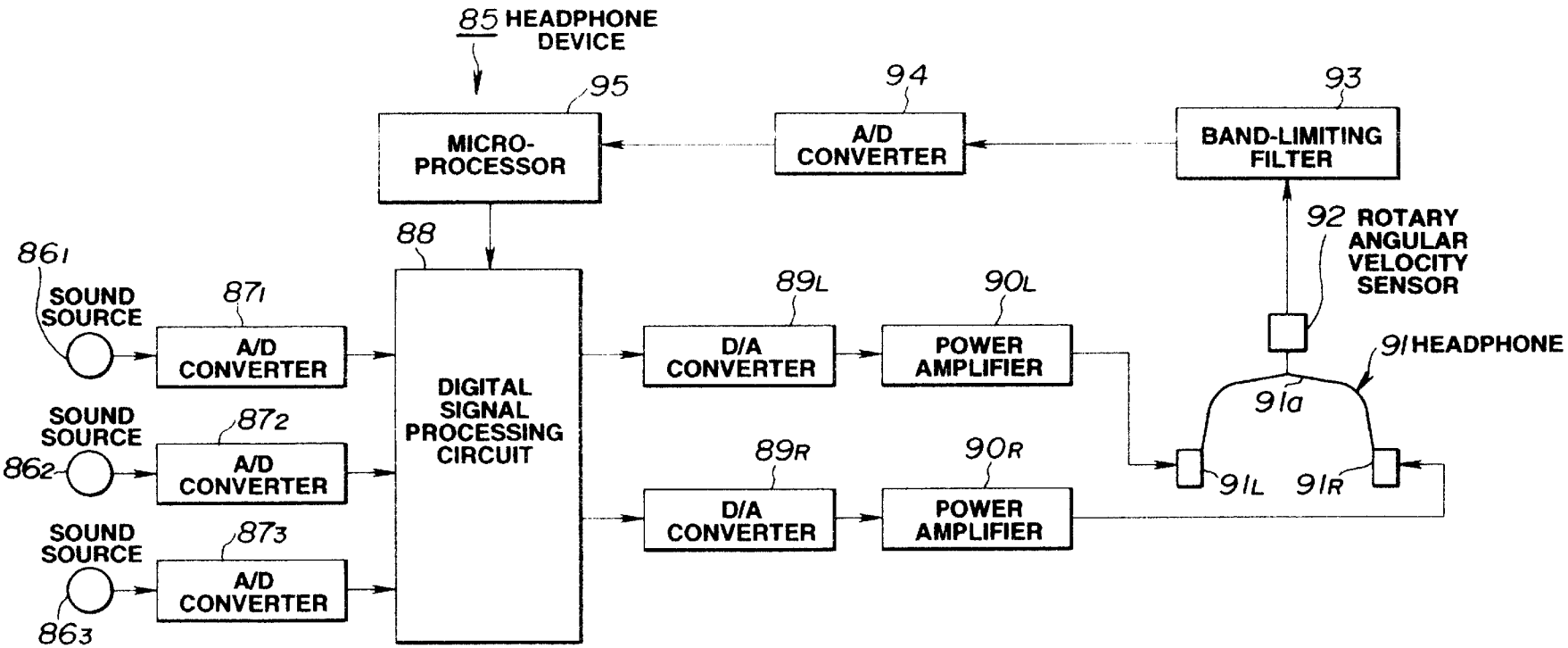
FIG. 17 is a block diagram showing a third embodiment of a headphone device according to the present invention.
Figure 18:
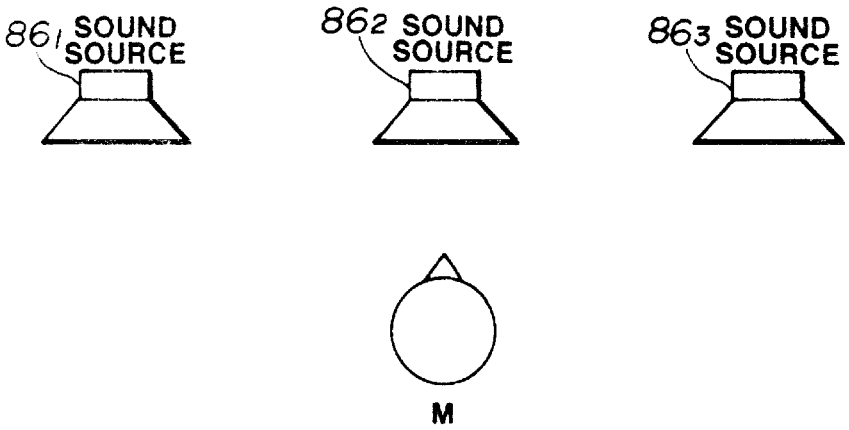
FIG. 18 is a schematic view showing the state assumed with the embodiment of FIG. 1.

A third embodiment of a headphone device according to the present invention is now explained. In the present third embodiment, it is assumed that the speech signals of the three channels are reproduced by sound sources $\mathbf{86}_1$, $\mathbf{86}_2$ and $\mathbf{86}_3$ arranged within a range of forward 180°, as shown in FIG. 17. In such case, the sound image by the speech signals reproduced by the sound source $\mathbf{86}_2$ may be distributed to and reproduced by the sound sources $\mathbf{86}_1$, $\mathbf{86}_3$, after attenuating the signal level of the corresponding speech signals, for reproducing a substantially equivalent sound image. Therefore, if there are entered multi-channel speech signals, those signals having closer localization position to other channels may be distributed and added to these other channels for decreasing the number of transmitted channels.

Referring to FIG. 17, the headphone device 85 includes a digital signal processing circuit 88 for receiving three-channel speech input signals from three sound sources $\mathbf{86}_1$, $\mathbf{86}_2$, $\mathbf{86}_3$, arranged at the positions of localizing the three-channel speech input signals, via three A/D converters $\mathbf{87}_1$, $\mathbf{87}_2$, $\mathbf{87}_3$, as digital signals, and for performing the above-mentioned digital signal processing on the three-channel speech input signals, and power amplifiers $\mathbf{90}_L$, $\mathbf{90}_R$ for splitting the speech digital signals processed by the digital signal processing circuit 4 with digital signal processing and for receiving the speech digital signals as analog signals via D/A converters $\mathbf{89}_L$, $\mathbf{89}_R$ for power amplification. The headphone device also includes a headphone 91 having sound enunciators $\mathbf{91}_L$, $\mathbf{91}_R$ driven by the power amplifiers $\mathbf{90}_L$, $\mathbf{90}_R$ and a rotary angular velocity sensor 92 mounted on a head band 91*a* of the headphone 91 for detecting the rotary angular velocity of the head of the user of the headphone 91. The headphone device further includes a micro-processor 95 having a rotary angle calculating function consisting in bandwidth-limiting a detection output of the rotary angular velocity sensor 92 by a bandwidth limiting filter 93, converting the resulting output into a digital signal by an A/D converter 94 and for calculating the rotary angle from the front direction of the headphone user. The signal processing contents in the digital signal processing circuit 88 are updated responsive to the rotary angle obtained by the micro-processor 95 for localizing the sound image in a pre-set direction outside the head of the headphone user. When the headphone 91 performs a rotary movement, the rotary angular velocity sensor 92 mounted on the headband 91*a* outputs a voltage proportionate to the angular velocity. This output signal is filtered by the band-limiting filter 93 and encoded by the A/D converter 94 before entering the micro-processor 95. The output signal of the A/D converter 94, entering the micro-processor 95, is sampled at a pre-set time interval and integrated so as to be converted into angular data. From the angular data, a rotary angle for actually localizing the sound image is calculated and the resulting processed data is transmitted to the digital signal processing circuit 88. The three-channel speech signals entering the three sound sources $\mathbf{86}_1$ to $\mathbf{86}_3$ are encoded by three A/D converters $\mathbf{87}_1$ to $\mathbf{87}_3$ before entering the digital signal processor 88. The digital signal processing circuit 88 performs digital signal processing for localizing the required speech signals outside the head of the user in accordance with the angular data calculated by the micro-processor 88, and outputs the results to the two D/A converters $\mathbf{89}_L$ and $\mathbf{89}_R$ associated with the stereo L and R channels, respectively. The speech signals, again converted by the two D/A converters $89_L$ and $89_R$, are supplied via power amplifiers $90_L$, $90_R$ to the speech enunciators $91_L$, $91_R$ of the headphone 91 for furnishing optimum outside-head localized sound image to the listener.

Figure 19:
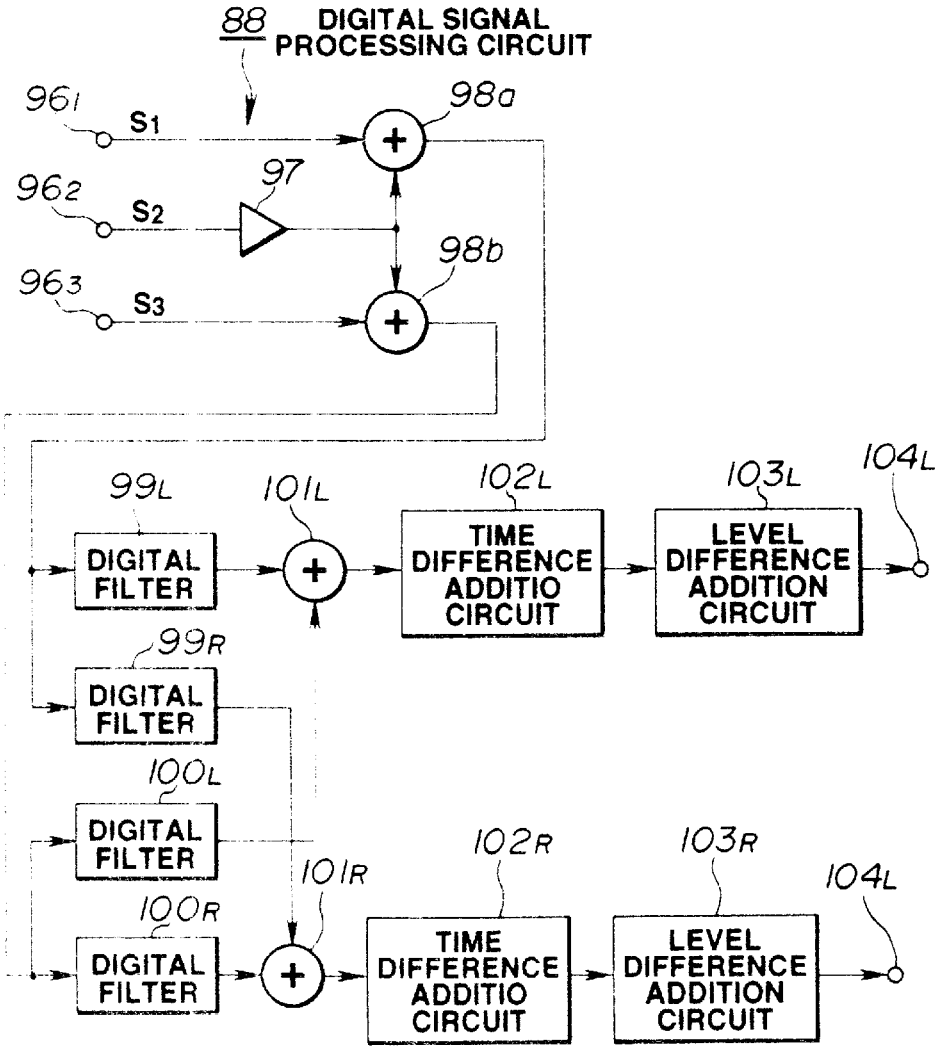
FIG. 19 is a block view showing a digital signal processing circuit employed in the embodiment of FIG. 17.

Referring to FIG. 19, the digital signal processing circuit 88 attenuates the level of an input signal $S_2$ supplied from an input terminal $96_2$ disposed between the sound image of the input signal $S_1$ supplied via an input terminal $96_1$ and the sound image of the input signal $S_3$ supplied via an input terminal $96_3$ by an attenuator 97, and sums an attenuated signal $S_2'$ by adders 98*a* and 98*b* to the input signals $S_1$ and $S_3$, respectively. A sum output $S_1+S_2'$ of the adder 98*a* is supplied to digital filters $99_L$ and $99_R$, while a sum output $S_3+S_2'$ of the adder $98_b$ is supplied to digital filters $100_L$ and $100_R$. Subsequently, digital filter outputs are summed by adders $101_L$, $101_R$ for each of the L and R channels outputted to the headphone 91. The time difference in case of the head being turned is added by the time difference addition circuits 102L, $102_R$, while the level difference is added by the level difference addition circuits 103L, $103_R$. In this manner, while the digital filter for the input signal $S_2$ is omitted, the sound image may be localized for all input signals. Output signals of the level difference addition circuit $103_L$ are supplied via output terminal $104_L$ to the D/A converter $89_L$. Output signals of the level difference addition circuit $103_R$ are supplied via an output terminal $104_R$ to the D/A converter $89_R$.

In the present headphone device 85, a phase difference addition circuit may be used in place of the time difference addition circuit. Also the frequency characteristics control circuit may be used in place of the level difference addition circuit.

As the rotary angular velocity sensor 92 employs in the present headphone device 85, the piezoelectric gyro device 32, analog angular velocity sensor 41 or the digital angular sensor 50 shown in FIGS. 11 to 13 may also be employed.

Figure 20:
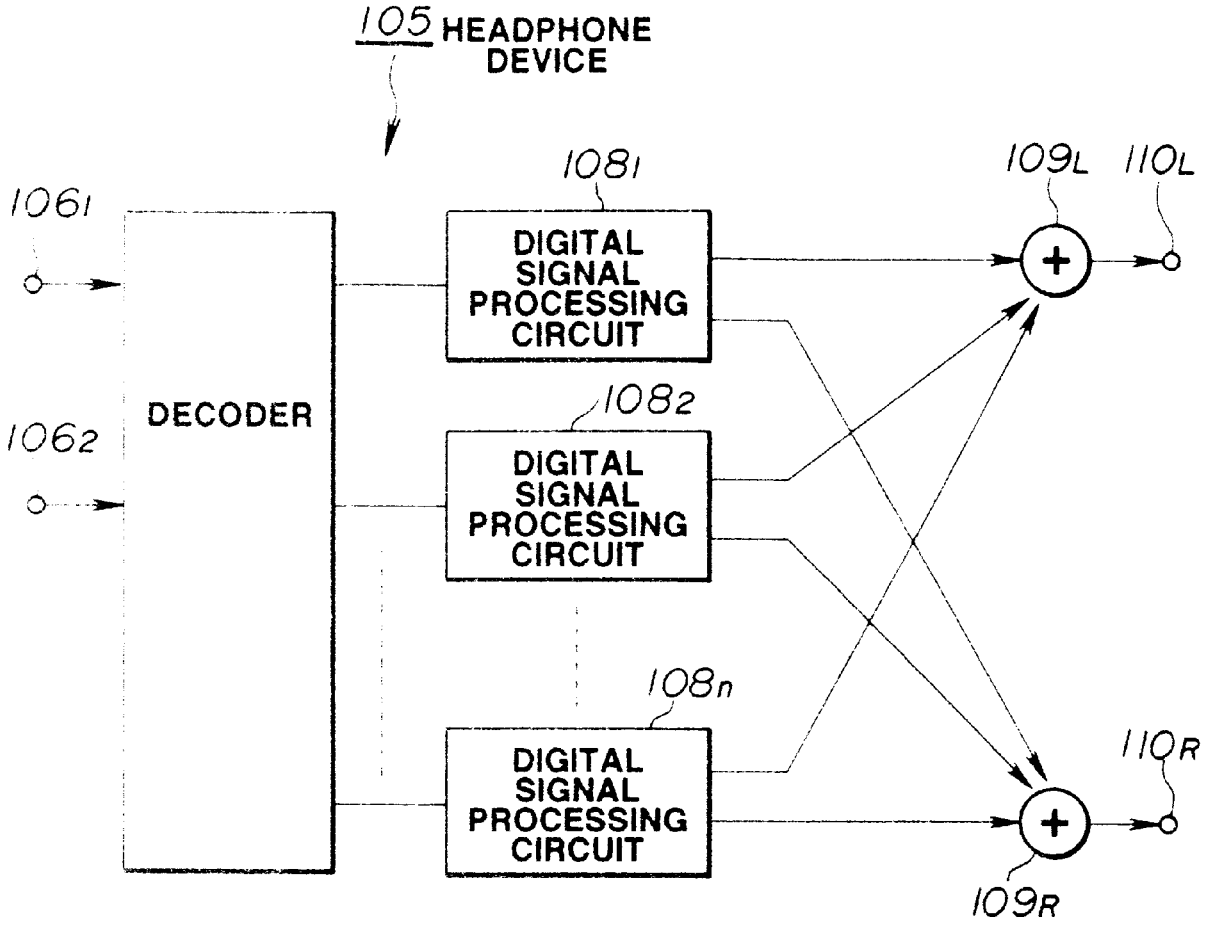
FIG. 20 is a block diagram showing a fourth embodiment of a headphone device according to the present invention.

Referring to FIG. 20, a fourth embodiment of a headphone device according to the present invention is explained. To input terminals $106_1$, $106_2$ are supplied signals encoded from multiple channels into, for example, two channels. These signals are decoded by a decoder 107 and supplied to digital signal processing circuits $108_1$, $108_2$, . . . $108_n$. The digital signal processing circuits $108_1$, $108_2$, . . . $108_n$ may be configured as digital signal processing circuits such as are shown in FIGS. 2, 6, 8, 10 and 16.

Thus, with the present fourth embodiment, the outside-head localized sound image for multiple channels may be realized in headphone listening solely by having two-channel speech input terminals.

What is claimed is:

1. A headphone device comprising:

signal processing means for performing signal processing on N-channel speech input signals, where N is an integer;

power amplifying means for power amplifying speech signals processed by said signal processing means;

a headphone driven by outputs from said power amplifying means; and angle of rotational movement detection means mounted on said headphone and including angle of rotational movement calculation means for receiving a detection output from said angle of rotational movement detection means and calculating an angle of rotational movement from a direction in front of a headphone user, in which signal processing contents in said signal processing means are updated responsive to said angle of rotational movement calculated by said angle of rotational movement calculation means for localizing a sound image in a preset localization direction outside said headphone user's head, wherein said signal processing means includes:

2N digital filter means for convolving an impulse response converted into a time domain from a head transfer function for both ears of said headphone user from N sound sources placed at such positions as to localize said N-channel speech input signals in an angular range of 360° outside said headphone user's head, a first pair of addition means for summing, respectively, all L outputs and all R outputs of 2M ones of said 2N digital filter means that are associated with M channels among said N channels, where M is an integer and N is not smaller than M, a second pair of addition means for summing, respectively, all L outputs and all R outputs of 2 (N-M) other ones of said 2N digital filter means associated with (N-M) other channels among said N channels, a first pair of time difference addition means respectively connected to L and R outputs of said first pair of addition means, a second pair of time difference addition means respectively connected to L and R outputs of said second pair of addition means, a third pair of addition means for summing, respectively, all L outputs and all R outputs of said first pair of time difference addition means and said second pair of time difference addition means, a first pair of level difference addition means respectively located on one of an input side and an output side of said first pair of time difference addition means, and a second pair of level difference addition means respectively located on one of an input side and an output side of said second pair of time difference addition means, wherein an increasing/decreasing direction of a time difference added to said L outputs by said first pair of time difference addition means and said second pair of time difference addition means is opposite an increasing/decreasing direction of a time difference added to said R outputs by said first pair of time difference addition means and said second pair of time difference addition means, and respective amounts of said time difference added to said L and R outputs depend on said angle of rotational movement detected by said angle of rotational movement calculation means and vary linearly with said angle of rotation movement for angles between −90° to +90°, and an increasing/decreasing direction of a level difference added to said L outputs by said first pair of level difference addition means and said second level difference addition means is opposite an increasing/decreasing direction of a level difference added to said R outputs by said first pair of level difference addition means and said second pair of level difference addition means, and respective amounts of said level difference added to said L and R outputs depend on said angle of rotational movement detected by said angle of rotational movement calculation means and vary linearly with said angle of rotation movement for angles substantially between −90° and +90°.

2. The headphone device as claimed in claim 1, wherein said signal processing means further includes a first pair of frequency characteristics controlling means respectively located on one of an input side and an output side of said first pair of time difference addition means and a second pair of frequency characteristics controlling means respectively located on one of an input side and on an output side of said second pair of time difference addition means such that a changing direction of frequency characteristics of said L outputs controlled by said first pair of frequency characteristics controlling means and said second pair of frequency characteristics controlling means is opposite a changing direction of frequency characteristics of said R outputs controlled by said first pair of frequency characteristics controlling means and said second pair of frequency characteristics controlling means, and respective amounts of change in said frequency characteristics of said L and R outputs depend on said angle of rotational movement detected by said angle of rotational movement calculation means.

3. The headphone device as claimed in claim 1, wherein an angular velocity sensor is used as said angle of rotational movement detection means.

4. The headphone device as claimed in claim 1, wherein a geomagnetic azimuth sensor is used as said angle of rotational movement detection means.

5. The headphone device as claimed in claim 1, wherein said angle of rotational movement detection means calculates said angle of rotational movement using an output ratio of light emitting means placed forwardly or laterally and at least two light intensity sensors provided on said headphone.

6. The headphone device as claimed in claim 1, wherein said angle of rotational movement detection means includes a plurality of microphones mounted at two separate positions on said headphone, and an ultrasonic oscillator placed one of forwardly and laterally of said headphone user, wherein said oscillator generates intermittent burst signals received by said plurality of microphones for calculating said angle of rotational movement based on a time difference of respective received signals.

7. The headphone device as claimed in claim 1, wherein said angle of rotational movement detection means and said signal processing means are configured for being mounted simultaneously on said headphone.

8. The headphone device as claimed in claim 1, wherein said N-channel speech input signals may be supplied over a radio path to said headphone.

9. A headphone device comprising:

signal processing means for performing signal processing on N-channel speech input signals, where N is an integer;

power amplifying means for power amplifying speech signals processed by said signal processing means;

a headphone driven by outputs from said power amplifying means; and angle of rotational movement detection means mounted on said headphone and including angle of rotational movement calculation means for receiving a detection output from said angle of rotational movement detection means and calculating an angle of rotational movement from a direction in front of a headphone user, in which signal processing contents in said signal processing means are updated responsive to said angle of rotational movement calculated by said angle of rotational movement calculation means for localizing a sound image in a preset localization direction outside said headphone user's head, wherein said signal processing means includes:

2N digital filter means for convolving an impulse response converted into a time domain from a head transfer function for both ears of said headphone user from N sound sources placed at positions so as to localize N-channel speech input signals in an angular range of 360° outside said headphone user's head, where N is an integer, a first pair of addition means for summing, respectively, all L outputs and all R outputs of 2M ones of said 2N digital filter means associated with M channels among said N channels, where M is an integer less than or equal to N, a second pair of addition means for summing, respectively, all L outputs and all R outputs of 2 (N-M) other ones of said 2N digital filter means associated with (N-M) other channels, a first pair of phase difference addition means respectively connected to L and R outputs of said first pair of addition means, a second pair of phase difference addition means respectively connected to L and R outputs of said second pair of addition means, a third pair of addition means for summing, respectively, all L outputs and all R outputs of said first pair of phase difference addition means and said second pair of phase difference addition means, a first pair of level difference addition means respectively located on one of an input side and an output side of said first pair of phase difference addition means, and a second pair of level difference addition means respectively located on one of an input side and an output side of said second pair of phase difference addition means, wherein an increasing/decreasing direction of a phase difference added to said L outputs by said first pair of phase difference addition means and said second pair of phase difference addition means is opposite an increasing/decreasing direction of a phase difference added to said R outputs by said first pair of phase difference addition means and said second pair of phase difference addition means, and respective amounts of said phase difference added to said L and R outputs depend on said angle of rotational movement detected by said angle of rotational movement calculation means, and a changing direction of a level difference added to said L outputs by said first pair of the level difference addition means and said second pair of the level difference addition means is opposite an increasing/decreasing direction of a level difference added to said R outputs by said first pair of level difference addition means and said second pair of level difference addition means, and respective amounts of said level difference added to said L outputs and said R outputs depend on said angle of rotational movement detected by said angle of rotational movement calculation means and vary linearly with said angle of rotation movement for angles between −90° to +90°.

10. The headphone device as claimed in claim 9, wherein said signal processing means further includes a first pair of frequency characteristics controlling means respectively located on one of an input side and an output side of said first pair of phase difference addition means and a second pair of frequency characteristics controlling means respectively located on one of an input side and an output side of said second pair of phase difference addition means such that a changing direction of frequency characteristics of said L outputs controlled by said first pair of frequency characteristics controlling means and said second pair of frequency characteristics controlling means is opposite a changing direction of frequency characteristic of said R outputs controlled by said first pair of frequency characteristics controlling means and said second pair of frequency characteristics controlling means, and respective amounts of change in said frequency characteristics of said L and R outputs depend on said angle of rotational movement detected by said angle of rotational movement detected by said angle of rotational movement calculation means.

11. A headphone device comprising:

signal processing means for performing signal processing on N-channel speech input signals, where N is an integer;

power amplifying means for power amplifying speech signals processed by said signal processing means;

a headphone driven by outputs from said power amplifying means;

rotational angle detection means mounted on said headphone; and angle of rotational movement calculation means for receiving a detection output from said rotational angle detection means and for calculating an angle of rotational movement from a direction in front of a headphone user, in which signal processing contents in said signal processing means are updated responsive to said angle of rotational movement calculated by said angle of rotational movement calculation means for localizing a sound image in a pre-set localization direction outside said headphone user's head, wherein said signal processing means includes:

2N digital filter means for convolving an impulse response converted into a time domain from a head transfer function for both ears of said headphone user from N sound sources placed at positions so as to localize N-channel speech input signals in an angular range of 360° outside said headphone user's head, a pair of addition means for summing, respectively, all L outputs and all R outputs of M ones of said 2N digital filter means of respective M channels contained in each of a plurality of blocks divided from said N-channels of said input speech signals depending on a direction of localization for said headphone user facing in a front direction as a reference state, where M is an integer less than or equal to N, a pair of time difference addition means respectively connected to L and R outputs of said pair of addition means, addition means for summing, respectively, all L outputs and all R outputs from said pair of time difference addition means, and a pair of level difference addition means respectively located on one of an input side and an output side of said pair of time difference addition means, wherein a respective level difference added by said pair of level difference addition means is independently changed responsive to said angle of rotational movement as calculated by said angle of rotational movement calculation means and varies linearly with said angle of rotation movement for angles substantially between −90° to +90°, and an amount of time difference added by said pair of time difference addition means is independently changed from block to block depending on said angle of rotational movement calculated by said angle of rotational movement calculation means and varies linearly with said angle of rotation movement for angles between −90° to +90°.

12. The headphone device as claimed in claim 11, wherein said signal processing means further includes a pair of frequency characteristics control means respectively located on one of an input side and an output side of said pair of time difference addition means such that frequency characteristics controlled by said pair of frequency characteristics control means are independently changed depending on said angle of rotational movement calculated by said angle of rotational movement calculation means.

13. A headphone device comprising:

signal processing means for performing signal processing on N-channel speech input signals, where N is an integer;

power amplifying means for power amplifying speech signals processed by said signal processing means;

a headphone driven by outputs from said power amplifying means;

rotational angle detection means mounted on said headphone;

angle of rotational movement calculation means for receiving a detection output from said rotational angle detection means and calculating an angle of rotational movement from a direction in front of a headphone user, in which signal processing contents in said signal processing means are updated responsive to said angle of rotational movement calculated by said angle of rotational movement calculation means for localizing a sound image in a preset localization direction outside said headphone user's head;

classification means for classifying said N-channel speech input signals into a plurality of blocks depending on said localization direction, with a reference state corresponding to said headphone user facing a front side, and for producing L and R outputs, said L and R outputs being supplied to said signal processing means; and a pair of addition means for summing, respectively, all L outputs and all R outputs from said signal processing means and supplying summed L and R outputs to said power amplifying means as said signals processed by said signal processing means, wherein said signal processing means includes 2N digital filter means for convolving an impulse response converted into a time domain from a transfer function for both ears of said headphone user from N sound sources placed at positions so as to localize said N-channel speech input signals in an angular range of 360° outside said headphone user's head, a pair of filter addition means for summing, respectively, all L outputs and all R outputs of said 2N digital filters means, a pair of phase difference addition means respectively connected to L and R outputs of said pair of filter addition means, wherein an amount of phase difference added by said pair of phase difference addition means is independently changed from block to block depending on said angle of rotational movement calculated by said angle of rotational angle calculations means, and a pair of level difference addition means respectively located on one of an input side and an output side of said pair of phase difference addition means, wherein a level difference added by said pair of level difference addition means is independently changed responsive to said angle of rotational movement calculated by said angle of rotational movement calculation means and varies linearly with said angle of rotation movement for angles substantially between −90° to +90°.

14. The headphone device as claimed in claim 13, wherein said signal processing means further includes a pair of frequency characteristics controlling means respectively located on one of an input side and an output side of said pair of phase difference addition means such that frequency characteristics controlled by said pair of frequency characteristics control means are independently changed depending on said angle of rotational movement calculated by said angle of rotational movement calculation means.

* * * * *